US011132933B2

(12) United States Patent
Ishida et al.

(10) Patent No.: US 11,132,933 B2
(45) Date of Patent: Sep. 28, 2021

(54) CIRCUIT DEVICE, ELECTRO-OPTICAL DEVICE, AND ELECTRONIC APPARATUS

(71) Applicant: SEIKO EPSON CORPORATION, Tokyo (JP)

(72) Inventors: Jun Ishida, Chino (JP); Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/285,576

(22) Filed: Feb. 26, 2019

(65) Prior Publication Data

US 2019/0266937 A1 Aug. 29, 2019

(30) Foreign Application Priority Data

Feb. 27, 2018 (JP) ..... JP2018-032855

(51) Int. Cl.
*G09G 3/20* (2006.01)

(52) U.S. Cl.
CPC ..... *G09G 3/2092* (2013.01); *G09G 2310/027* (2013.01); *G09G 2310/0291* (2013.01); *G09G 2370/14* (2013.01)

(58) Field of Classification Search
CPC ..... G09G 3/2092; G09G 3/2096; G09G 2310/027; G09G 3/006; G09G 2310/0291
USPC ..... 345/204
See application file for complete search history.

(56) References Cited

U.S. PATENT DOCUMENTS 5,625,361 A * 4/1997 Garrity ..... H03H 19/004 341/172
2005/0066077 A1 3/2005 Shibata et al.
2006/0284754 A1* 12/2006 Garrity ..... H03M 1/1225 341/172
2009/0237174 A1 9/2009 Morita
2009/0258626 A1 10/2009 Yamada et al.
2013/0229211 A1 9/2013 Nishiyama et al.
2013/0266055 A1 10/2013 Matsumoto et al.
2017/0132966 A1* 5/2017 Lim ..... G09G 3/2092

FOREIGN PATENT DOCUMENTS

JP H08-237127 A 9/1996
JP 2005-236931 A 9/2005
JP 2008-300979 A 12/2008
JP 2009-225406 A 10/2009
JP 2009-253814 A 10/2009
(Continued)

*Primary Examiner* — Yuzhen Shen
(74) *Attorney, Agent, or Firm* — Oliff PLC

(57) ABSTRACT

A circuit device includes a first input terminal, a second input terminal, a reception circuit including a non-inverted input terminal and an inverted input terminal, a first signal line electrically coupling a non-inverted input terminal of the reception circuit and the first input terminal and having a first coupling node and a second coupling node, a second signal line electrically coupling an inverted input terminal of the reception circuit and the second input terminal and having a third coupling node and fourth coupling node, a first variable capacitance circuit having an end coupled to the first coupling node and another end coupled to the second coupling node, and a second variable capacitance circuit having an end coupled to the third coupling node and another end coupled to the fourth coupling node.

10 Claims, 14 Drawing Sheets

(56) References Cited

FOREIGN PATENT DOCUMENTS

| | | | | |
|---|---|---|---|---|
| JP | 2013-219543 | A | 10/2013 | |
| WO | 2012/060017 | A1 | 5/2012 | |
| WO | 2018/056100 | A1 | 3/2018 | |
| WO | WO-2018056100 | A1 * | 3/2018 | ..... H04B 3/04 |

* cited by examiner

CIRCUIT DEVICE, ELECTRO-OPTICAL DEVICE, AND ELECTRONIC APPARATUS

BACKGROUND

1. Technical Field

The invention relates to a circuit device, an electro-optical device, and an electronic apparatus, for example.

2. Related Art

High-speed serial transfer, such as Low Voltage Differential Signaling (LVDS), is known that serves as an interface capable of achieving high-speed communications between circuit devices. In the high-speed serial transfer, a transmission circuit transmits serialized data with differential signals, while a reception circuit differentially amplifies the differential signals, achieving data transfer. JP-A-2009-225406 and JP-A-2005-236931, for example, disclose such techniques about high-speed serial transfer as described above.

In the high-speed serial transfer, a signal delay due to a capacitance and a parasitic resistance at an input terminal of a circuit device is a major issue. Such a method for reducing a signal delay as described above is conceivable that allows a signal to undergo alternating current (AC) coupling to reduce a direct current (DC) component to improve frequency characteristics. The method, however, requires a capacitor having a greater capacitance, leading to an increase in power consumption. Such a method for suppressing a signal delay and a decrease in amplitude is further conceivable in which an amplifier circuit referred to as an equalizer is provided around an input terminal of a circuit device to increase amplitude when a signal level changes. The method, however, causes such issues as an excessive increase in size and power consumption for a circuit device due to the amplifier circuit.

SUMMARY

An aspect of the invention relates to a circuit device including a first input terminal configured to accept, from among a first signal and a second signal configuring a differential signal, the first signal, a second input terminal configured to accept the second signal, a reception circuit including a non-inverted input terminal and an inverted input terminal, a first signal line electrically coupling the non-inverted input terminal of the reception circuit and the first input terminal, a second signal line electrically coupling the inverted input terminal of the reception circuit and the second input terminal, a first variable capacitance circuit having an end coupled to a first coupling node of the first signal line on a side adjacent to the first input terminal and another end coupled to a second coupling node of the first signal line on a side adjacent to the non-inverted input terminal, and a second variable capacitance circuit having an end coupled to a third coupling node of the second signal line on a side adjacent to the second input terminal and another end coupled to a fourth coupling node of the second signal line on a side adjacent to the inverted input terminal.

In the aspect of the invention, the first signal line may be provided with a first resistor between the first coupling node and the second coupling node, and the second signal line may be provided with a second resistor between the third coupling node and the fourth coupling node.

In the aspect of the invention, the first variable capacitance circuit may include a first switch group having an end coupled to the first coupling node, a second switch group having an end coupled to the second coupling node, and a first capacitor group provided between another end of the first switch group and another end of the second switch group, and the second variable capacitance circuit may include a third switch group having an end coupled to the third coupling node, a fourth switch group having an end coupled to the fourth coupling node, and a second capacitor group provided between another end of the third switch group and another end of the fourth switch group.

In the aspect of the invention, a capacitance setting circuit configured to set capacitances of the first variable capacitance circuit and the second variable capacitance circuit may be included.

In the aspect of the invention, a register configured to store setting information about the capacitances of the first variable capacitance circuit and the second variable capacitance circuit may be included.

In the aspect of the invention, a third variable capacitance circuit having an end coupled to the second coupling node and another end coupled to a ground node, a fourth variable capacitance circuit having an end coupled to the fourth coupling node and another end coupled to the ground node, and a monitoring circuit configured to accept an output signal of the reception circuit, to monitor a signal delay in the output signal when the capacitances of the third variable capacitance circuit and the fourth variable capacitance circuit are changed, and to output a result of monitoring may be included.

In the aspect of the invention, a first terminal and a second terminal may further be included, and the monitoring circuit may include a retaining circuit configured to sample the output signal of the reception circuit based on a clock signal to be entered from the first terminal, to retain a result of sampling, and to output a signal about the result of sampling being retained to the second terminal.

In the aspect of the invention, the third variable capacitance circuit may include a fifth switch group having an end coupled to the second coupling node, a sixth switch group having an end coupled to the ground node, and a third capacitor group provided between another end of the fifth switch group and another end of the sixth switch group, and the fourth variable capacitance circuit may include a seventh switch group having an end coupled to the fourth coupling node, an eighth switch group having an end coupled to the ground node, and a fourth capacitor group provided between another end of the seventh switch group and another end of the eighth switch group.

In the aspect of the invention, a variable resistance circuit provided between the non-inverted input terminal and the inverted input terminal, and having a variable resistance value may be included.

Another aspect of the invention relates to an electro-optical device including the circuit device, described above, including a display driver circuit configured to accept an output signal of the reception circuit as a data signal to drive an electro-optical panel, and the electro-optical panel.

Still another aspect of the invention relates to an electronic apparatus including the circuit device described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Some exemplary embodiments of the disclosure will be described in detail hereinafter. Note that the exemplary embodiments described hereinafter are not intended to limit the content of the disclosure as set forth in the claims, and not all of the configurations described in the exemplary embodiments are absolutely required to address the issues described in the disclosure.

1. Circuit Device

Figure 1:
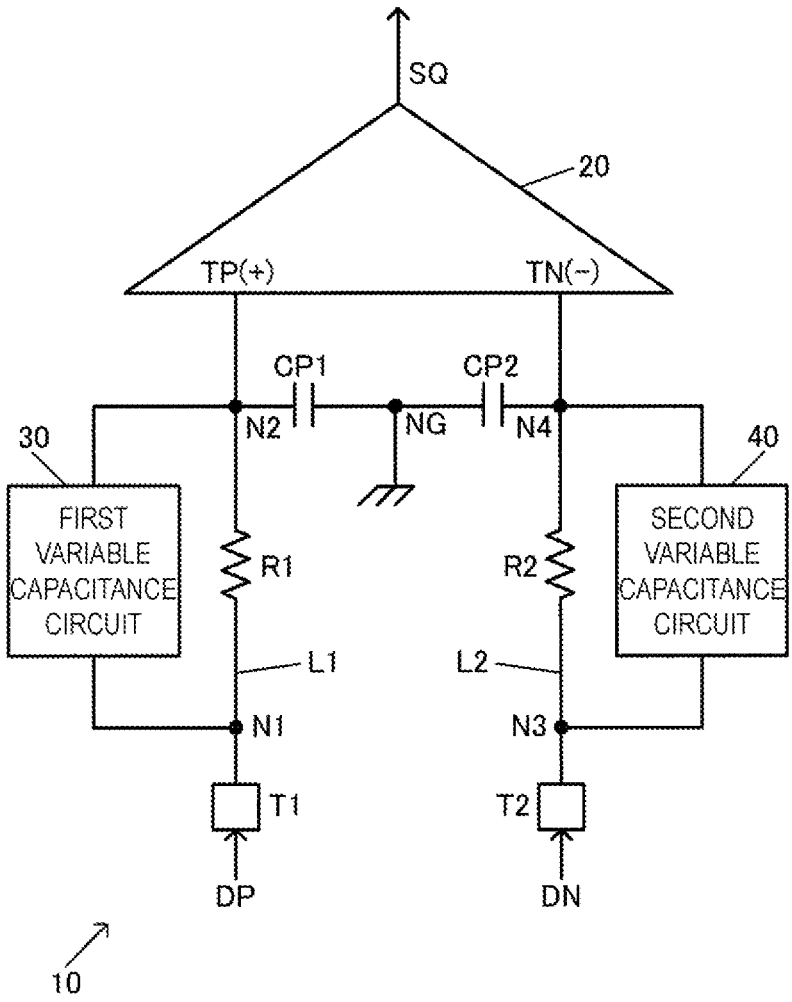
FIG. 1 is a diagram illustrating a configuration example of a circuit device according to the exemplary embodiment.

FIG. 1 illustrates a configuration example of a circuit device 10 according to the exemplary embodiment. The circuit device 10 includes input terminals T1 and T2, a reception circuit 20, signal lines L1 and L2, a first variable capacitance circuit 30, and a second variable capacitance circuit 40. The circuit device 10 represents an interface circuit, such as a high-speed serial interface circuit.

The input terminal T1 (first input terminal) is configured to accept, from among a signal DP (first signal) and a signal DN (second signal) configuring a differential signal, the signal DP. The input terminal T2 (second input terminal) is configured to accept the signal DN. Specifically, the signal DP and the signal DN configure a differential signal (LVDS) having smaller amplitude. For example, the signals DP and DN respectively are a first data signal and a second data signal configuring a differential data signal. The input terminals T1 and T2 are achieved by pads of the circuit device 10. The input terminals T1 and T2 are arranged in an input/output (I/O) region serving as a pad arrangement region of the circuit device 10.

The reception circuit 20 includes a non-inverted input terminal TP and an inverted input terminal TN. The signal DP and the signal DN configuring a differential signal respectively enter into the non-inverted input terminal TP and the inverted input terminal TN of the reception circuit 20. The reception circuit 20 is configured to differentially amplify the signals DP and DN, and to output an output signal SQ. As will be described later, the reception circuit 20 can be achieved with a circuit configured to perform current-voltage conversion on the signals DP and DN being current signals to generate a first voltage and a second voltage, and a comparator configured to accept the first voltage and the second voltage, for example.

The signal line L1 (first signal line) is provided between the non-inverted input terminal TP of the reception circuit 20 and the input terminal T1. The signal line L1 electrically couples the non-inverted input terminal TP and the input terminal T1. The signal line L2 (second signal line) is provided between the inverted input terminal TN of the reception circuit 20 and the input terminal T2. The signal line L2 electrically couples the inverted input terminal TN and the input terminal T2.

The first variable capacitance circuit 30 has an end coupled to a coupling node N1 (first coupling node) of the signal line L1 on a side adjacent to the input terminal T1 and another end coupled to a coupling node N2 (second coupling node) of the signal line L1 on a side adjacent to the non-inverted input terminal TP. The coupling node N1 is arranged adjacent to the input terminal T1. The coupling node N2 is arranged adjacent to the non-inverted input terminal TP. The coupling nodes N1 and N2 serve as coupling points of the first variable capacitance circuit 30 to the signal line L1, for example. The first variable capacitance circuit 30 variably sets a capacitance between the coupling nodes N1 and N2.

The second variable capacitance circuit 40 has an end coupled to a coupling node N3 (third coupling node) of the signal line L2 on a side adjacent to the input terminal T2 and another end coupled to a coupling node N4 (fourth coupling node) of the signal line L2 on a side adjacent to the inverted input terminal TN. The coupling node N3 is arranged adjacent to the input terminal T2. The coupling node N4 is arranged adjacent to the inverted input terminal TN. The coupling nodes N3 and N4 serve as coupling points of the second variable capacitance circuit 40 to the signal line L2, for example. The second variable capacitance circuit 40 variably sets a capacitance between the coupling nodes N3 and N4.

A capacitance CP1 represents a total capacitance (including a parasitic capacitance) between a signal line for the signal DP and a ground node NG. A capacitance CP2 represents a total capacitance (including a parasitic capacitance) between a signal line for the signal DN and the ground node NG. The ground node NG represents a node for grounding (GND).

For example, the capacitance CP1 includes a wire capacitance of the signal line L1 in the circuit device 10, a gate capacitance of a transistor having a gate coupled to the signal line L1, and a drain capacitance of a transistor having a drain coupled to the signal line L1, for example. The transistor having the gate coupled to the signal line L1 is a transistor configuring the reception circuit 20, for example. The transistor having the drain coupled to the signal line L1 is a transistor configuring a switch of the first variable capacitance circuit 30, for example. The circuit device 10 performs communications with an external circuit device. The signals DP and DN are to be output from a transmission circuit of the external circuit device. The external circuit device serves as a host device, such as a host controller. At this time, the circuit device 10 serves as a target device, for example. The capacitance CP1 includes a capacitance of a signal line coupling the external circuit device and the input terminal T1 of the circuit device 10. The signal line is wired to a wiring substrate, for example. The wiring substrate may be a rigid substrate or a flexible substrate.

The capacitance CP2 includes a wire capacitance of the signal line L2 in the circuit device 10, a gate capacitance of a transistor having a gate coupled to the signal line L2, and a drain capacitance of a transistor having a drain coupled to the signal line L2, for example. The transistor having the gate coupled to the signal line L2 is a transistor configuring the reception circuit 20, for example. The transistor having the drain coupled to the signal line L2 is a transistor configuring a switch of the second variable capacitance circuit 40, for example. The capacitance CP2 includes a capacitance of a signal line coupling the external circuit device and the input terminal T2 of the circuit device 10. The signal line is wired to a wiring substrate, for example.

In FIG. 1, the signal line L1 is provided with a resistor R1 (first resistor) between the coupling node N1 and the coupling node N2, while the signal line L2 is provided with a resistor R2 (second resistor) between the coupling node N3 and the coupling node N4. Specifically, the signal line L1 has a first signal line portion coupling the input terminal T1 and an end of the resistor R1 and a second signal line portion coupling another end of the resistor R1 and the non-inverted input terminal TP. The signal line L2 has a third signal line portion coupling the input terminal T2 and an end of the resistor R2 and a fourth signal line portion coupling another end of the resistor R2 and the inverted input terminal TN. The resistors R1 and R2 are used for impedance matching, for example. The resistors R1 and R2 can be achieved by resistance elements made of polysilicon or resistance elements in impurity layers, such as diffusion layers, for example. The resistors R1 and R2 each have a resistance value varying from approximately several Ω to approximately several tens of Ω, for example. The resistors R1 and R2 may be parasitic resistances in the signal lines L1 and L2.

Figure 2:
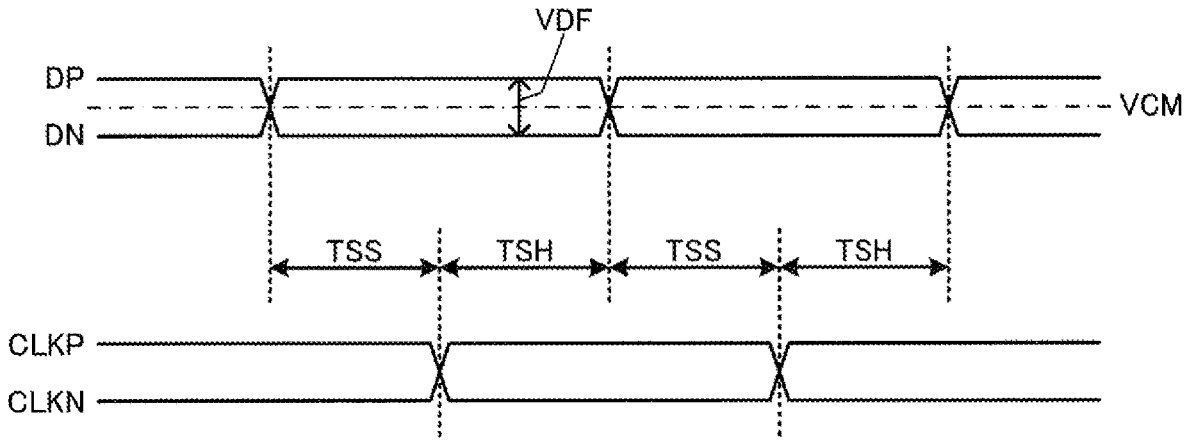
FIG. 2 is a signal waveform diagram illustrating how the circuit device according to the exemplary embodiment operates.

FIG. 2 is a signal waveform diagram illustrating how the circuit device 10 according to the exemplary embodiment operates. A common-mode voltage of a differential signal is represented as VCM, and varies from approximately 1 V to approximately 1.3 V, for example. As illustrated in FIG. 2, the signals DP and DN each change toward a positive electrode side or a negative electrode side based on the common-mode voltage VCM. A differential voltage representing amplitude of the differential signal is represented as VDF, and varies from approximately 200 mV to approximately 500 mV, for example.

The external circuit device includes the transmission circuit for data transfer purpose and configured to output the signals DP and DN, and a transmission circuit for clock transfer purpose and configured to transmit clock signals CLKP and CLKN. The clock signals CLKP and CLKN also configure the differential signal. The circuit device 10 receives data signals including the signals DP and DN and the clock signals CLKP and CLKN from the external circuit device. For example, the circuit device 10 includes a reception circuit for clock transfer purpose. The reception circuit is configured to receive the clock signals CLKP and CLKN. The signals CLKP and CLKN can be received with a circuit configuration similar to the circuit configuration for the signals DP and DN. The circuit device 10 uses the clock signals CLKP and CLKN to sample the signals DP and DN. For example, rising edges and falling edges of the clock signals CLKP and CLKN are used to sample the signals DP and DN. A setting-up time in this case is represented as TSS. A holding time in this case is represented as TSH.

As described above, the capacitances CP1 and CP2 are respectively present in the signal lines for the signals DP and DN. The capacitances CP1 and CP2 and the resistors R1 and R2, for example, would blur waveforms of the signals DP and DN, generating a signal delay. As a result, the setting-up time TSS in FIG. 2 becomes insufficient, leading to such an event that the circuit device 10 cannot appropriately receive the signals DP and DN. To suppress such an event described above, the exemplary embodiment is provided with the first and second variable capacitance circuits 30 and 40.

Figure 3:
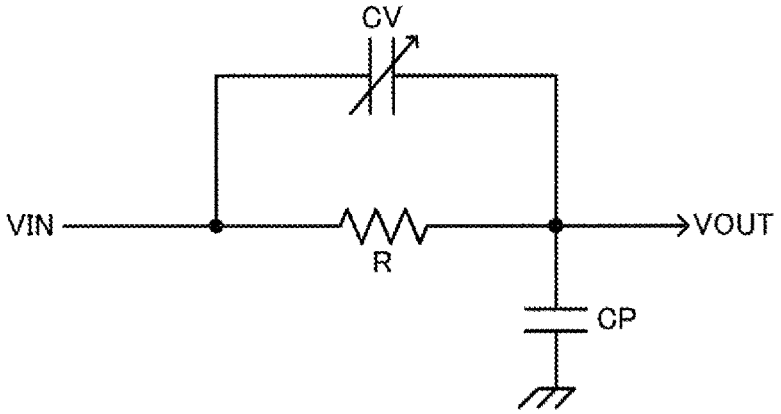
FIG. 3 is an explanatory diagram illustrating a method for reducing a signal delay, according to the exemplary embodiment.
Figure 4:
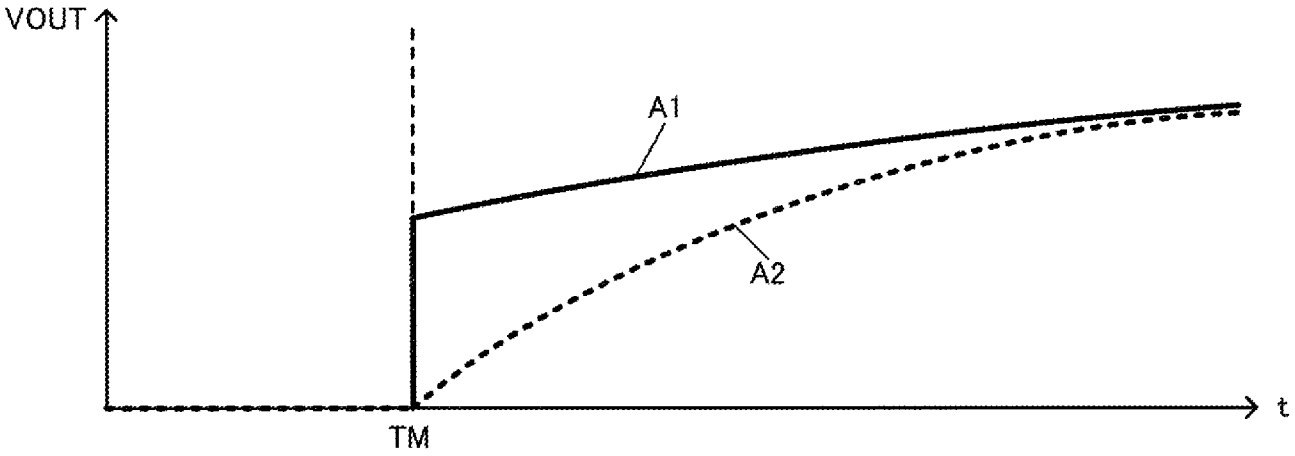
FIG. 4 is an explanatory diagram illustrating the method for reducing a signal delay, according to the exemplary embodiment.

FIGS. 3 and 4 are explanatory diagrams illustrating a method for reducing a signal delay, according to the exemplary embodiment. In FIG. 3, a capacitance CP represents the capacitance CP1 or CP2 in FIG. 1, while a resistor R represents the resistor R1 or R2 or a parasitic resistance in a signal line. A capacitance CV represents a capacitance to be set with the first variable capacitance circuit 30 or the second variable capacitance circuit 40. FIG. 4 illustrates a result of simulation on a signal waveform of an output signal VOUT when a signal VIN enters into the circuit in FIG. 3. The signal VIN corresponds to the signal DP or the signal DN. The output signal VOUT corresponds to an input signal at the non-inverted input terminal TP or an input signal at the inverted input terminal TN of the reception circuit 20. At a timing TM in FIG. 4, a signal level of the signal VIN changes from a L level (low level) to a H level (high level). A signal waveform illustrated as A1 in FIG. 4 represents a signal waveform of the output signal VOUT when a capacitance of the first variable capacitance circuit 30 or the second variable capacitance circuit 40 is set as CV=CP. On the other hand, a signal waveform illustrated as A2 represents a signal waveform of the output signal VOUT when CV=0.

In the signal waveform illustrated as A2 in FIG. 4, if the first and second variable capacitance circuits 30 and 40 according to the exemplary embodiment are not provided, a low-pass filter property based on the capacitance CP and the resistor R would blur a signal waveform, generating a signal delay. If a signal delay described above is generated, the setting-up time TSS in FIG. 2, for example, becomes insufficient. As a result, the signals DP and DN cannot be appropriately sampled and received.

In contrast, in the signal waveform illustrated as A1, when the first and second variable capacitance circuits 30 and 40 according to the exemplary embodiment are provided, a signal delay can be reduced, compared with A2. That is, the low-pass filter property based on the capacitance CP and the resistor R can be canceled out by a high-pass filter property based on the capacitance CV and the resistor R, reducing a signal delay. In other words, the signal waveform illustrated as A2 due to the low-pass filter property can be waveform-shaped into the signal waveform illustrated as A1.

For example, in FIG. 4, a response property of the circuit in FIG. 3 within a high-frequency bandwidth would significantly affect a response property of the output signal VOUT when the signal VIN changes from the L level to the H level at the timing TM. Within the high-frequency bandwidth, an impedance of the resistor R greatly increases, whereas an impedance ZV of the capacitance CV and an impedance ZP of the capacitance CP reduce. Therefore, a voltage level of the output signal VOUT when the signal VIN changes from the L level to the H level is determined with ZP/(ZP+ZV). The impedance of the capacitance CP can be represented as ZP=1/(jωCP). The impedance of the capacitance CV can be represented as ZV=1/(jωCV). When CV=0, ZP/(ZP+ZV) reduces. The voltage level of the output signal VOUT also lowers. That is, when CV=0, the circuit in FIG. 3 serves as a low-pass filter circuit, blurring the output signal VOUT illustrated as A2 in FIG. 4 due to the low-pass filter property, and generating a signal delay. On the other hand, with a setting of CV=CP, ZP/(ZP+ZV) increases, compared with the case when CV=0. As a result, when the signal VIN changes from the L level to the H level at the timing TM in FIG. 4, the output signal VOUT also changes from the L level to the H level with a prompt rising property illustrated as A1, reducing a signal delay.

As described above, in the circuit device 10 according to the exemplary embodiment, by providing the first and second variable capacitance circuits 30 and 40, the low-pass filter property based on the capacitances CP1 and CP2 and the resistors R1 and R2 is canceled out, suppressing the signal waveforms of the signals DP and DN from blurring. Therefore, as illustrated with A1 in FIG. 4, a signal delay in the signals DP and DN can be reduced. Therefore, the signals DP and DN can promptly rise and fall as illustrated in FIG. 2, preventing such an event that the setting-up time TSS becomes insufficient. Therefore, even when the external circuit device transmits the signals DP and DN at higher transfer speeds, the setting-up time TSS can be secured, allowing the circuit device 10 to appropriately receive the signals DP and DN. Therefore, high-speed serial transfer allowing a large amount of data to be received at a higher speed can be achieved. For example, not only signal transfer at a several hundred megahertz order, but also high-speed serial transfer at a gigahertz order can be achieved.

In the exemplary embodiment, the signal line L1 is provided with the resistor R1 between the coupling nodes N1 and N2, while the signal line L2 is provided with the resistor R2 between the coupling node N3 and N4. By providing the resistors R1 and R2 as described above, impedance matching can take place during high-speed serial transfer. With the high-pass filters respectively formed based on the resistors R1 and R2 and the capacitances of the first and second variable capacitance circuits 30 and 40, the low-pass filter property illustrated as A2 in FIG. 4 can be canceled out, achieving a signal waveform with less signal delay illustrated as A1. Therefore, signal delays in the signals DP and DN can be reduced, achieving high-speed serial transfer allowing a large amount of data to be received at a higher speed.

Figure 5:
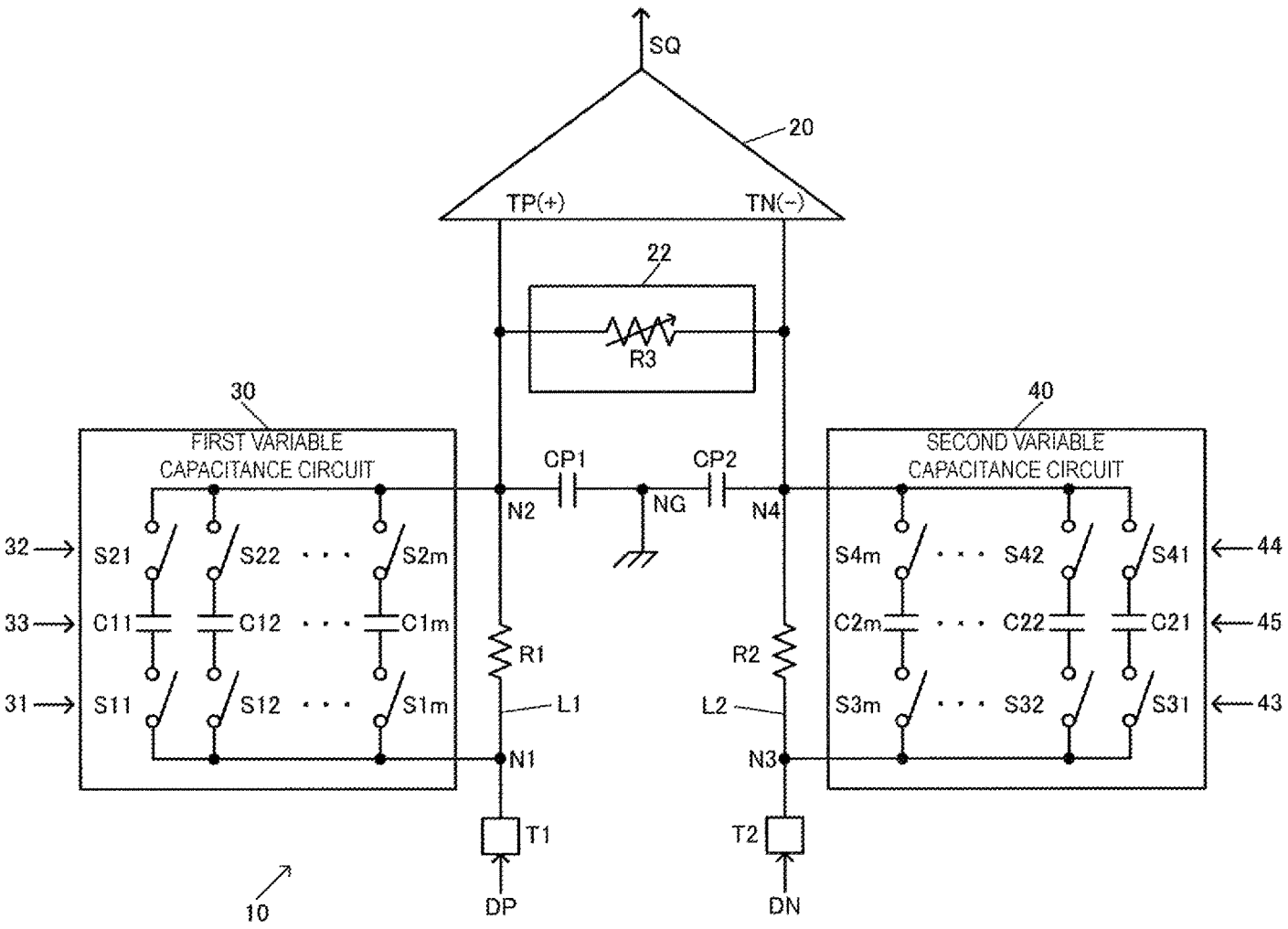
FIG. 5 is a diagram illustrating a detailed configuration example of first and second variable capacitance circuits.

FIG. 5 illustrates a detailed configuration example of the circuit device 10 according to the exemplary embodiment. FIG. 5 illustrates a detailed configuration example of the first and second variable capacitance circuits 30 and 40. In FIG. 5, a variable resistance circuit 22 having a variable resistance value is provided between the non-inverted input terminal TP and the inverted input terminal TN. The variable resistance circuit 22 includes a resistor R3 having a variable resistance value. The variable resistance circuit 22 will be described later in detail.

The first variable capacitance circuit 30 includes a first switch group 31, a second switch group 32, and a first capacitor group 33. The first switch group 31 includes switches S11 to S1*m*. The second switch group 32 includes switches S21 to S2*m*. The first capacitor group 33 includes capacitors C11 to C1*m*. The letter "m" represents an integer of 2 or greater. The first switch group 31 has an end coupled to the coupling node N1. The second switch group 32 has an end coupled to the coupling node N2. The first capacitor group 33 is provided between the first switch group 31 and the second switch group 32. For example, the first switch group 31 has another end coupled to an end of the first capacitor group 33. The second switch group 32 has another end coupled to another end of the first capacitor group 33. The switches in the exemplary embodiment are achieved by metal oxide semiconductor field effect (MOS) transistors or transfer gates, for example.

The second variable capacitance circuit 40 includes a third switch group 43, a fourth switch group 44, and a second capacitor group 45. The third switch group 43 includes switches S31 to S3*m*. The fourth switch group 44 includes switches S41 to S4*m*. The second capacitor group 45 includes capacitors C21 to C2*m*. The third switch group 43 has an end coupled to the coupling node N3. The fourth switch group 44 has an end coupled to the coupling node N4. The second capacitor group 45 is provided between the third switch group 43 and the fourth switch group 44. For example, the third switch group 43 has another end coupled to an end of the second capacitor group 45. The fourth switch group 44 has another end coupled to another end of the second capacitor group 45.

With the configuration described above, by setting the switches of the first and second switch groups 31 and 32 to on or off, the capacitance of the first variable capacitance circuit 30 can be set with a desired capacitance value. By setting the switches of the third and fourth switch groups 43 and 44 to on or off, the capacitance of the second variable capacitance circuit 40 can be set with a desired capacitance value. For example, the capacitances of the first and second variable capacitance circuits 30 and 40 can be respectively set to be equal to the capacitances CP1 and CP2. Therefore, the capacitance of the first variable capacitance circuit 30 can be set with an optimum capacitance value in accordance with the capacitances CP1 and CP2.

Capacitances of the capacitors C11 to C1*m* configuring the first capacitor group 33 are respectively set to follow a ratio of power of 2 of a capacitance of the capacitor C11, such as C12=2×C11, C13=$2^2$×C11, and C14=$2^3$×C11. Similarly, capacitances of the capacitor C21 to C2*m* configuring the second capacitor group 45 are respectively set to follow a ratio of power of 2 of a capacitance of the capacitor C21, such as C22=2×C21, C23=$2^2$×C21, and C24=$2^3$×C21. As described above, capacitance values of the capacitances of the first and second variable capacitance circuits 30 and 40 can be appropriately set based on respective bits of digital data. The configuration of the first and second variable capacitance circuits 30 and 40 is not limited to the configuration illustrated in FIG. 5. For example, the first and second variable capacitance circuits 30 and 40 may be achieved by using variable capacitive elements such as varicaps.

Figure 6:
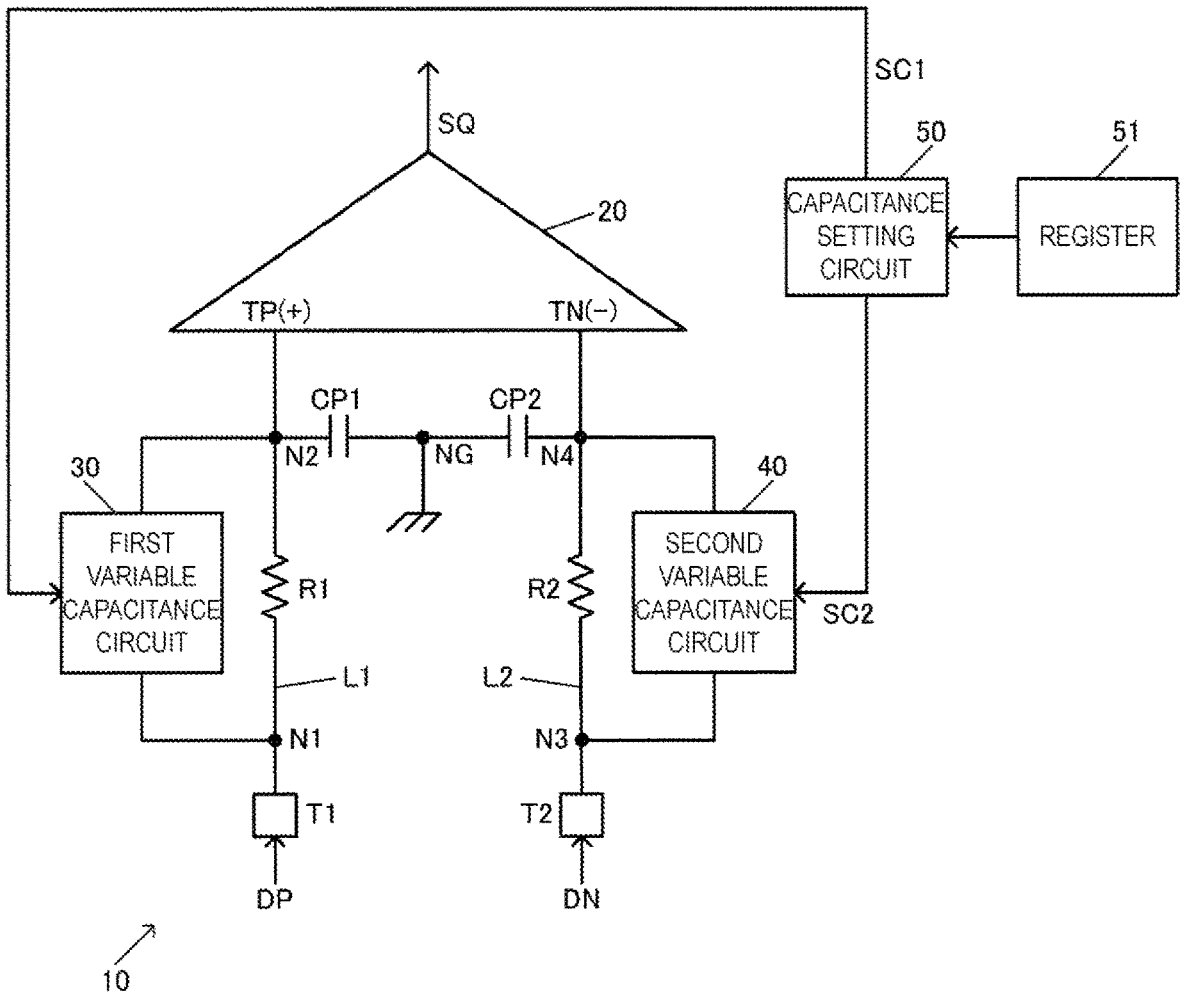
FIG. 6 is an explanatory diagram illustrating how capacitances are set using a capacitance setting circuit and a register.

As illustrated in FIG. 6, the circuit device 10 includes a capacitance setting circuit 50 configured to set the capacitances of the first and second variable capacitance circuits 30 and 40. The capacitance setting circuit 50 turns the switches of the first and second switch groups 31 and 32 of the first variable capacitance circuit 30 in FIG. 5 to on or off to set the capacitance of the first variable capacitance circuit 30.

For example, by using a capacitance setting signal SC1 to turn on or off the switches of the first and second switch groups 31 and 32, the capacitance of the first variable capacitance circuit 30 is set. The capacitance setting circuit 50 further turns on or off the switches of the third and fourth switch groups 43 and 44 of the second variable capacitance circuit 40 to set the capacitance of the second variable capacitance circuit 40. For example, by using a capacitance setting signal SC2 to turn on or off the switches of the third and fourth switch groups 43 and 44, the capacitance of the second variable capacitance circuit 40 is set. The capacitance setting circuit 50 may be achieved with a fuse circuit and a non-volatile memory. For example, the capacitance setting circuit 50 outputs the capacitance setting signals SC1 and SC2 based on a fuse set value of the fuse circuit or a set value stored in the non-volatile memory to set the capacitances of the first and second variable capacitance circuits 30 and 40. Otherwise, the capacitance setting circuit 50 may be achieved with a logic circuit configured to generate a control signal.

By providing the capacitance setting circuit 50 described above, the capacitances of the first and second variable capacitance circuits 30 and 40 can be set with desired capacitance values. Therefore, the capacitances can be set to allow the signals DP and DN to have appropriate signal waveforms illustrated as A1 in FIG. 4.

The circuit device 10 includes a register 51 configured to store setting information about the capacitances of the first and second variable capacitance circuits 30 and 40. The register 51 can be achieved by a flip-flop circuit, for example. The register 51 may be achieved by a random access memory (RAM) such as a static random access memory (SRAM). For example, the register 51 stores, as the setting information about the capacitances, on-off setting information about the switches of the first and second switch groups 31 and 32 of the first variable capacitance circuit 30. The register 51 further stores, as the setting information about the capacitances, on-off setting information about the switches of the third and fourth switch groups 43 and 44 of the second variable capacitance circuit 40. For example, the capacitance setting circuit 50 sets the capacitances of the first and second variable capacitance circuits 30 and 40 based on the setting information about the capacitances stored in the register 51. For example, the capacitance setting circuit 50 includes a logic circuit configured to generate the capacitance setting signals SC1 and SC2, and then generates the capacitance setting signals SC1 and SC2 based on the setting information about the capacitances sent from the register 51 and outputs the capacitance setting signals SC1 and SC2 to the first variable capacitance circuit 30 and the second variable capacitance circuit 40. For example, the circuit device 10 accepts, from the external circuit device, a writing command for the setting information about the capacitances. Based on the writing command, the setting information about the capacitances is written onto the register 51.

By providing the register 51 described above, the setting information about the capacitances allowing the signals DP and DN to have appropriate signal waveforms illustrated as A1 in FIG. 4 can be written from the external circuit device onto the register 51. Based on the fuse set value of the fuse circuit or a set value read from the non-volatile memory, the setting information about the capacitances may be written onto the register 51.

2. Second Configuration Example

Figure 7:
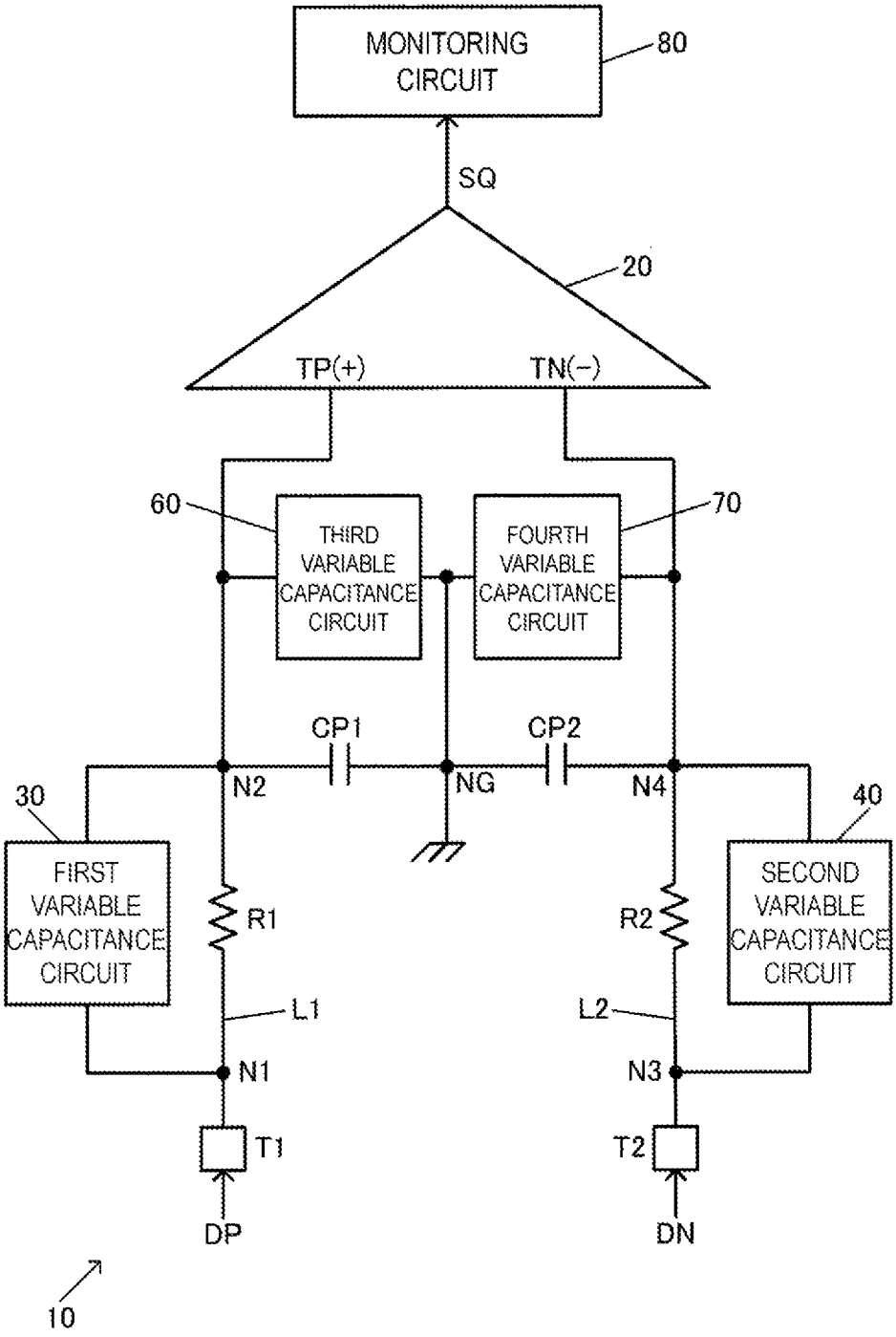
FIG. 7 is a diagram illustrating a second configuration example of the circuit device according to the exemplary embodiment.

FIG. 7 illustrates a second configuration example of the circuit device 10 according to the exemplary embodiment. The circuit device 10 according to the second configuration example is provided with, in addition to the configuration in FIG. 1, a third variable capacitance circuit 60, a fourth variable capacitance circuit 70, and a monitoring circuit 80. The third variable capacitance circuit 60 has an end coupled to the coupling node N2 and another end coupled to the ground node NG. The third variable capacitance circuit 60 is configured to variably set a capacitance between the coupling node N2 and the ground node. The fourth variable capacitance circuit 70 has an end coupled to the coupling node N4 and another end coupled to the ground node NG. The fourth variable capacitance circuit 70 is configured to variably set a capacitance between the coupling node N4 and the ground node. The monitoring circuit 80 is configured to accept the output signal SQ of the reception circuit 20. The output signal SQ represents a single-end signal obtained by differentially amplifying the signals DP and DN, for example. The monitoring circuit 80 monitors a signal delay in the output signal SQ when the capacitances of the third and fourth variable capacitance circuits 60 and 70 are changed, and outputs a result of monitoring. For example, the monitoring circuit 80 outputs, as a result of monitoring, monitoring information used for monitoring a signal delay in the output signal SQ when the capacitances of the third and fourth variable capacitance circuits 60 and 70 are changed.

As described above, with the circuit device 10 according to the second configuration example, a signal delay in the output signal SQ when the capacitances of the third and fourth variable capacitance circuits 60 and 70 are changed can be monitored with the monitoring circuit 80. Therefore, as will be described later with reference to FIGS. 9 and 10, based on a result of monitoring by the monitoring circuit 80 when the capacitances of the third and fourth variable capacitance circuits 60 and 70 are changed, the capacitances CP1 and CP2 can be measured. Based on a result of measurement of the capacitance values of the capacitances CP1 and CP2, the capacitances of the first and second variable capacitance circuits 30 and 40 can be set. For example, based on a result of measurement of the capacitances CP1 and CP2, the capacitance setting circuit 50 in FIG. 6 sets the capacitances of the first and second variable capacitance circuits 30 and 40 to capacitances corresponding to the capacitances CP1 and CP2. As an example, the capacitances of the first and second variable capacitance circuits 30 and 40 are respectively set to be equal to the capacitances CP1 and CP2. As described above, the signals DP and DN to be entered into the reception circuit 20 can have signal waveforms with less signal delay illustrated as A1 in FIG. 4. Therefore, signal delays in the signals DP and DN can be reduced, achieving high-speed serial transfer allowing a large amount of data to be received at a higher speed.

Figure 8:
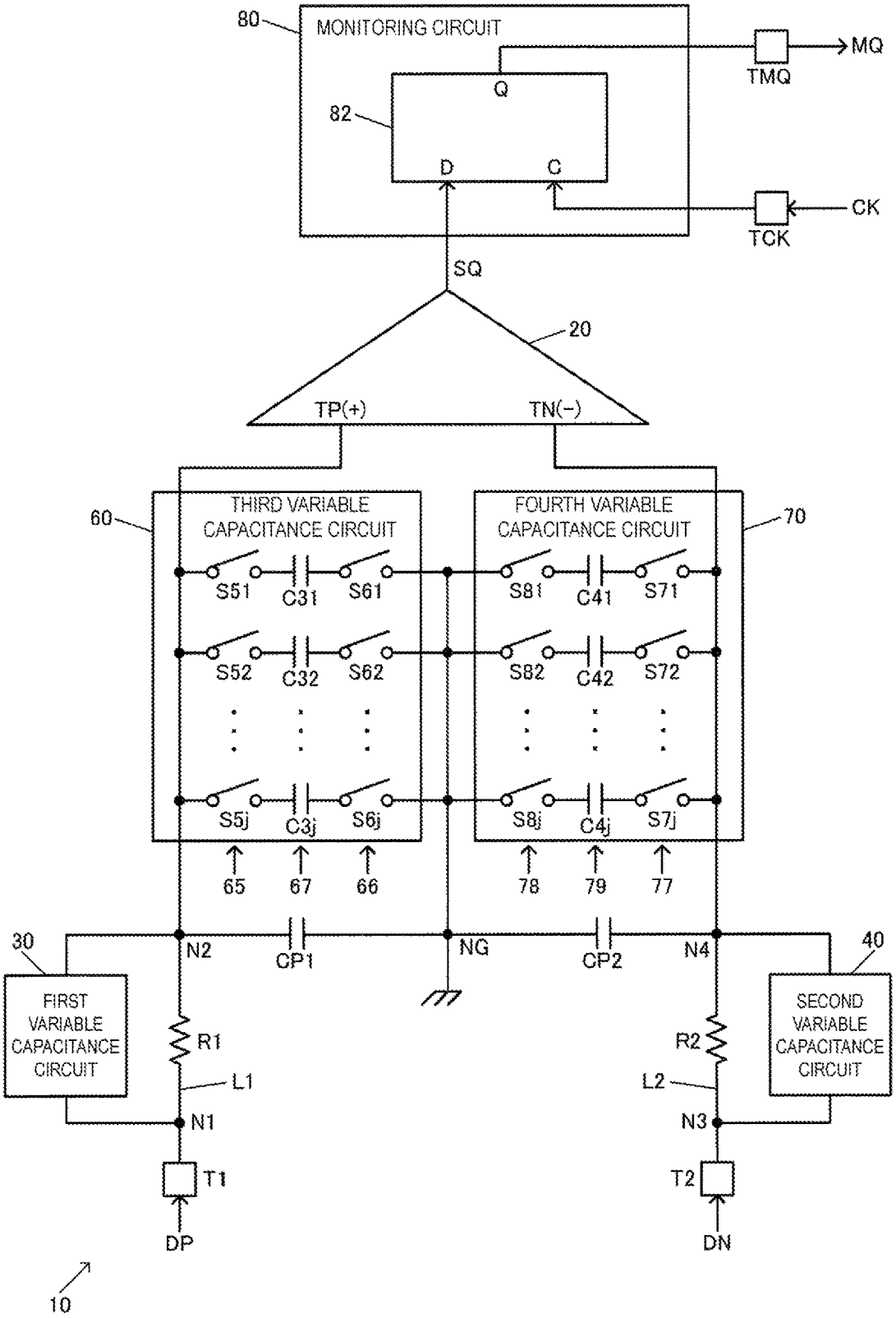
FIG. 8 is a diagram illustrating a detailed configuration example of third and fourth variable capacitance circuits and a monitoring circuit.

FIG. 8 illustrates a detailed configuration example of the third and fourth variable capacitance circuits 60 and 70 and the monitoring circuit 80. The third variable capacitance circuit 60 includes a fifth switch group 65, a sixth switch group 66, and a third capacitor group 67. The fifth switch group 65 includes switches S51 to S5*j*. The sixth switch group 66 includes switches S61 to S6*j*. The third capacitor group 67 includes capacitors C31 to C3*j*. The letter "j" represents an integer of 2 or greater. The fifth switch group 65 has an end coupled to the coupling node N2. The sixth switch group 66 has an end coupled to the ground node NG. The third capacitor group 67 is provided between the fifth switch group 65 and the sixth switch group 66. For example, the fifth switch group 65 has another end coupled to an end of the third capacitor group 67. The sixth switch group 66 has another end coupled to another end of the third capacitor group 67.

The fourth variable capacitance circuit 70 includes a seventh switch group 77, an eighth switch group 78, and a fourth capacitor group 79. The seventh switch group 77 includes switches S71 to S7*j*. The eighth switch group 78 includes switches S81 to S8*j*. The fourth capacitor group 79 includes capacitors C41 to C4*j*. The seventh switch group 77 has an end coupled to the coupling node N4. The eighth switch group 78 has an end coupled to the ground node NG. The fourth capacitor group 79 is provided between the seventh switch group 77 and the eighth switch group 78. For example, the seventh switch group 77 has another end coupled to an end of the fourth capacitor group 79. The eighth switch group 78 has another end coupled to another end of the fourth capacitor group 79.

Capacitances of the capacitors C31 to C3*j* configuring the third capacitor group 67 are respectively set to follow a ratio of power of 2 of a capacitance of the capacitor C31, such as C32=2×C31 and C33=$2^2$×C31. Similarly, capacitances of the capacitors C41 to C4*j* configuring the fourth capacitor group 79 are also respectively set to follow a ratio of power of 2 of a capacitance of the capacitor C41, such as C42=2×C41 and C43=$2^2$×C41.

Figure 11:
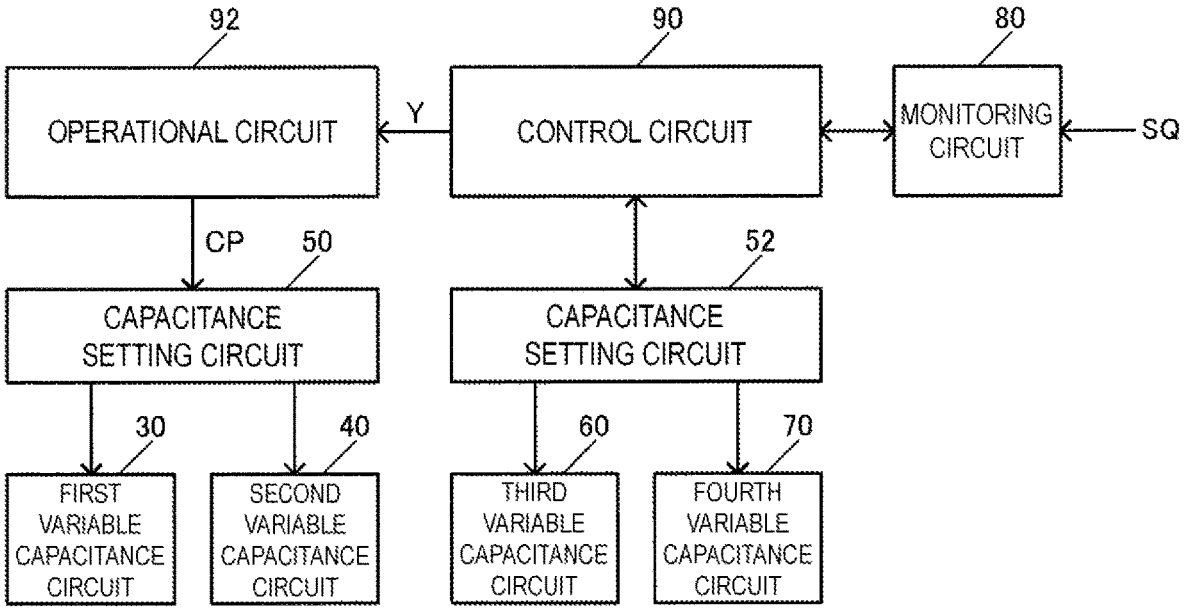
FIG. 11 is a diagram illustrating a configuration example of a circuit configured to measure a delay time in a signal to set capacitances of variable capacitance circuits.

With the configuration described above, by setting the switches of the fifth and sixth switch groups 65 and 66 to on or off, the capacitance of the third variable capacitance circuit 60 can be changed. By setting the switches of the seventh and eighth switch groups 77 and 78 to on or off, the capacitance of the fourth variable capacitance circuit 70 can be changed. A capacitance setting circuit 52 described later with reference to FIG. 11 is configured to set the switches of the third and fourth variable capacitance circuits 60 and 70 to on or off. In the exemplary embodiment, as described above, while the capacitances of the third and fourth variable capacitance circuits 60 and 70 are changed, the monitoring circuit 80 monitors a signal delay in the output signal SQ. Therefore, based on a result of monitoring by the monitoring circuit 80, the capacitances CP1 and CP2 can be measured. By setting the capacitances of the first and second variable capacitance circuits 30 and 40 to capacitances corresponding to the capacitances CP1 and CP2 being measured, signal delays in the signals DP and DN can be reduced, achieving high-speed serial transfer capable of receiving a large amount of data at a higher speed. The configuration of the third and fourth variable capacitance circuits 60 and 70 is not limited to the configuration in FIG. 8. For example, the third and fourth variable capacitance circuits 60 and 70 may be achieved by using variable capacitive elements such as varicaps.

As illustrated in FIG. 8, the circuit device 10 includes the monitoring circuit 80, a terminal TCK (first terminal), and a terminal TMQ (second terminal). The terminals TCK and TMQ are the pads of the circuit device 10, for example. For example, the monitoring circuit 80 is a circuit for testing purpose, while the terminals TCK and TMQ are terminals for testing purpose. The monitoring circuit 80 includes a retaining circuit 82. The retaining circuit 82 is achieved by a flip-flop circuit, for example. Based on a clock signal CK to be entered from the terminal TCK, the retaining circuit 82 samples the output signal SQ of the reception circuit 20 and retains a result of sampling. For example, at timings of a rising edge and a falling edge of the clock signal CK, whether the output signal SQ is at the L level or the H level is retained as a result of sampling. The retaining circuit 82 outputs a signal MQ representing the result of sampling being retained to the terminal TMQ. For example, while the circuit device 10 undergoes a test, an external tester outputs the clock signal CK to the terminal TCK of the circuit device 10. The tester accepts the signal MQ from the terminal TMQ. Based on the signal MQ representing the result of sampling based on the clock signal CK, the external tester obtains a delay time in the output signal SQ and measures the capacitances CP1 and CP2. Based on a result of measurement of capacitance values of the capacitances CP1 and CP2, the capacitances of the first and second variable capacitance circuits 30 and 40 are set. For example, by using the capacitance setting circuit 50 and the register 51 in FIG. 5, the capacitances of the first and second variable capacitance circuits 30 and 40 are set. Therefore, the circuit device 10 capable of shaping signal waveforms of the signals DP and DN into optimum signal waveforms to reduce a signal delay can be achieved.

The capacitances CP1 and CP2 can be measured and the capacitances of the first and second variable capacitance circuits 30 and 40 can be set based on a result of measurement as described above when the circuit device 10 is inspected before product shipping or when an electro-optical device 250 and an electronic apparatus 300, described later, configured to be equipped with the circuit device 10 are inspected before product shipping, for example.

Figure 9:
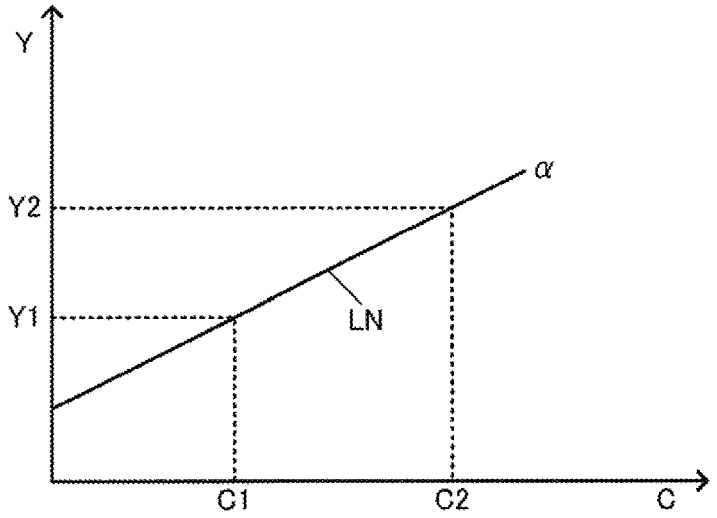
FIG. 9 is an explanatory diagram illustrating a method for measuring a capacitance and a delay time in a signal.

Next, a method for measuring a capacitance and a delay time in a signal will be described with reference to FIGS. 9 and 10. In FIG. 9, a horizontal axis represents a capacitance C, while a vertical axis represents a delay time Y in a signal.

In the exemplary embodiment, the capacitance C of the third variable capacitance circuit 60 or the fourth variable capacitance circuit 70 is changed to monitor the delay time Y in the output signal SQ. For example, when a capacitance is C=C1, a delay time in the output signal SQ is set as Y=Y1. When a capacitance is C=C2, a delay time in the output signal SQ is set as Y=Y2. Equations (1) and (2) described below are thus satisfied. Where, α corresponds to an inclination of a straight line LN in FIG. 9, and CP represents a capacitance to be measured.

$$Y1=\alpha(CP+C1) \tag{1}$$

$$Y2=\alpha(CP+C2) \tag{2}$$

When C2=2C1, the capacitance CP can be obtained as Equation (3) described below with Equations (1) and (2) described above. Therefore, by obtaining the delay times Y1 and Y2, the capacitance CP can be measured.

$$CP=(Y1+Y2)/2\alpha-3C1/2 \tag{3}$$

Figure 10:
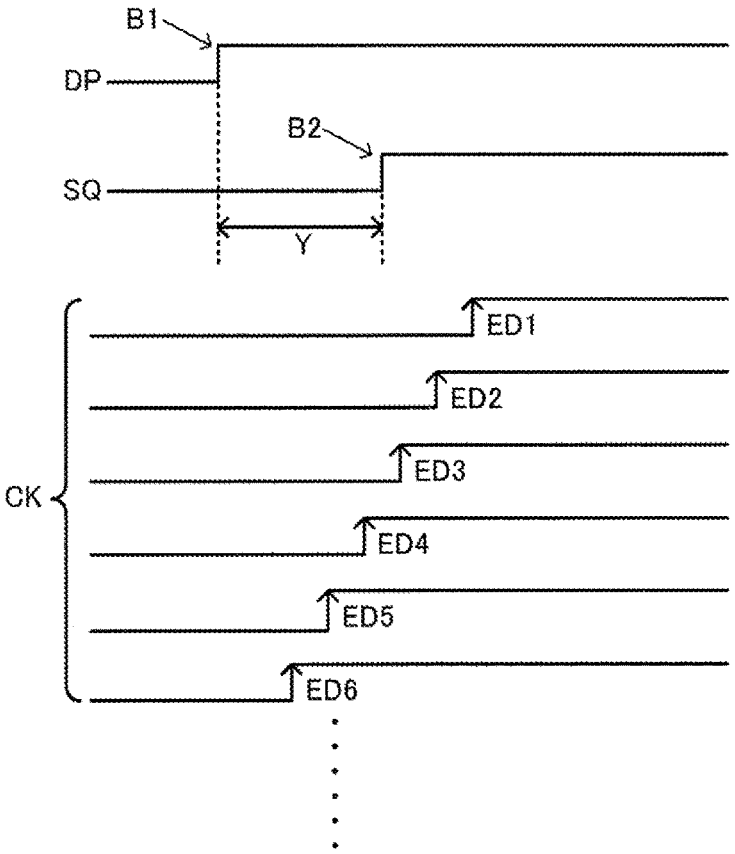
FIG. 10 is an explanatory diagram illustrating the method for measuring a capacitance and a delay time in a signal.

In FIG. 10, the signal DP changes from the L level to the H level at B1. The output signal SQ changes from the L level to the H level at B2. A time from the timing B1 to the timing B2 represents the delay time Y in the output signal SQ relative to the signal DP. Below describes an example when, while the capacitance of the third variable capacitance circuit 60 is changed, the delay time Y in the output signal SQ relative to the signal DP is obtained to measure the capacitance CP1. For example, to measure the capacitance CP2, while the capacitance of the fourth variable capacitance circuit 70 is changed, the delay time Y in the output signal SQ relative to the signal DN may be obtained.

In FIG. 10, the external tester is used to sequentially shift a timing of an edge of the clock signal CK to be entered into the terminal TCK in FIG. 8, for example. By using the tester, a timing of an edge of the clock signal CK can be shifted at an order of several tens of picoseconds, for example, achieving measuring the delay time Y with enough resolution. Further, the tester can enter the signals DP and DN into the circuit device 10.

In FIG. 10, it is determined that the output signal SQ has changed between a timing of an edge ED3 and a timing of an edge ED4 of the clock signal CK. Therefore, the delay time Y can be measured. Specifically, in FIG. 8, the output signal SQ is sampled by the retaining circuit 82 based on the clock signal CK sent from the external tester. A voltage level of the output signal SQ is then retained as a result of sampling. For example, in FIG. 10, the H level is retained as a result of sampling at an edge ED1, an edge ED2, and the edge ED3, while the L level is retained as a result of sampling at the edge ED4, an edge ED5, and an edge ED6. The signal MQ representing the result of sampling is entered into the tester from the terminal TMQ of the circuit device 10. Therefore, the tester can obtain the delay time Y. The capacitance of the third variable capacitance circuit 60 is then set as C=C1. The delay time Y=Y1 is therefore obtained. The capacitance of the third variable capacitance circuit 60 is then set as C=C2. The delay time Y=Y2 is therefore obtained. Therefore, CP=CP1 can be obtained with Equation (3) described above. With a similar method, while the capacitance of the fourth variable capacitance circuit 70 is changed, the delay times Y=Y1 and Y=Y2 in the output signal SQ relative to the signal DN are then obtained. The capacitance CP=CP2 can therefore be obtained.

FIG. 11 illustrates a configuration example of a circuit configured to measure a delay time in a signal and to automatically set capacitances of variable capacitance circuits. The circuit device 10 according to the exemplary embodiment can include the circuit illustrated in FIG. 11. The capacitance setting circuit 52 is controlled by a control circuit 90 to change the capacitances of the third and fourth variable capacitance circuits 60 and 70. The monitoring circuit 80 monitors a signal delay in the output signal SQ of the reception circuit 20 when the capacitances of the third and fourth variable capacitance circuits 60 and 70 are changed, and outputs a result of monitoring to the control circuit 90. Based on the result of monitoring output from the monitoring circuit 80, the control circuit 90 obtains the delay time Y and outputs the delay time Y to the operational circuit 92. Based on the delay time Y, the operational circuit 92 obtains the capacitance CP. The capacitance setting circuit 50 sets the capacitances of the first and second variable capacitance circuits 30 and 40 to allow the capacitances of the first and second variable capacitance circuits 30 and 40 to each be equal to the capacitance CP, for example.

Specifically, the capacitance setting circuit 52 is controlled by the control circuit 90 to set the capacitance of the third variable capacitance circuit 60 as C=C1, as illustrated in FIG. 9. While the capacitance is set as C=C1, as described above, the control circuit 90 obtains, based on the result of monitoring of the output signal SQ when the signal level of the signal DP is changed, the delay time Y=Y1 in the output signal SQ. For example, with the method describe above with reference to FIG. 10, the control circuit 90 obtains the delay time Y=Y1 in the output signal SQ and outputs the delay time Y=Y1 being obtained to the operational circuit 92. The capacitance setting circuit 52 is controlled by the control circuit 90 to set the capacitance of the third variable capacitance circuit 60 as C=C2, as illustrated in FIG. 9. While the capacitance is set as C=C2, as described above, the control circuit 90 obtains, based on the result of monitoring of the output signal SQ when the signal level of the signal DP is changed, the delay time Y=Y2 in the output signal SQ and outputs the delay time Y=Y2 being obtained to the operational circuit 92. The operational circuit 92 performs a computing process with Equation (3) described above to obtain the capacitance CP=CP1. The capacitance setting circuit 50 sets the capacitance of the first variable capacitance circuit 30 to allow the capacitance of the first variable capacitance circuit 30 to be equal to the capacitance CP1, for example.

Similarly, the capacitance setting circuit 52 sets the capacitance of the fourth variable capacitance circuit 70 as C=C1, obtains, based on a result of monitoring of the output signal SQ when the control circuit 90 has changed the signal level of the signal DN, the delay time Y=Y1 in the output signal SQ, and outputs the delay time Y=Y1 to the operational circuit 92. The capacitance setting circuit 52 sets the capacitance of the fourth variable capacitance circuit 70 as C=C2, obtains, based on a result of monitoring of the output signal SQ when the control circuit 90 has changed the signal level of the signal DN, the delay time Y=Y2 in the output signal SQ, and outputs the delay time Y=Y2 to the operational circuit 92. The operational circuit 92 performs a computing process with Equation (3) described above to obtain the capacitance CP=CP2. The capacitance setting circuit 50 sets the capacitance of the second variable capacitance circuit 40 to allow the capacitance of the second variable capacitance circuit 40 to be equal to the capacitance CP2, for example.

By providing a circuit configured as described above with reference to FIG. 11 in the circuit device 10, a signal delay in the output signal SQ can be monitored without using the external tester. Based on a result of monitoring, the capacitance CP can be obtained. The first and second variable capacitance circuits 30 and 40 can be automatically set with appropriate capacitances. For example, even when an external condition or a capacitance changes as a time passes by, the capacitances of the first and second variable capacitance circuits 30 and 40 can be automatically adjusted to appropriate capacitances.

3. Modification Example

Figure 12:
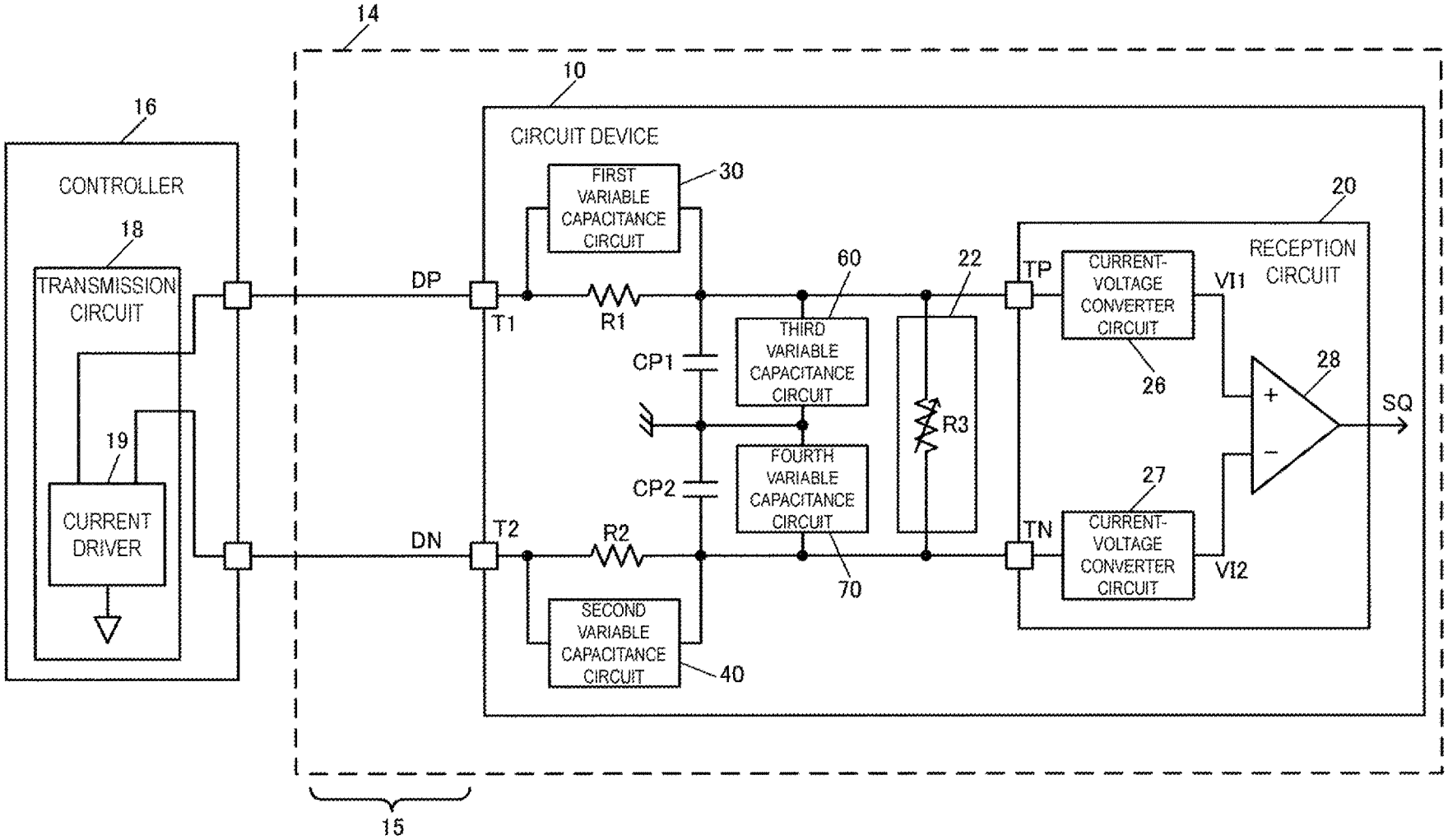
FIG. 12 is a diagram illustrating a modification example of the circuit device according to the exemplary embodiment.

Next, various modification examples to the exemplary embodiment will be described herein. In FIG. 12, a transmission circuit 18 of a controller 16 serving as the external circuit device includes a current driver 19. As the current driver 19 drives a current, the signals DP and DN enter into the circuit device 10. The controller 16 serves as a display controller configured to perform display control, for example. The reception circuit 20 of the circuit device 10 includes current-voltage converter circuits 26 and 27 and a comparator 28.

The current-voltage converter circuit 26 is configured to convert a drive current to be flowed toward a low potential power supply side by the current driver 19 into a voltage VI1, and to output the voltage VI1 to the comparator 28. The current-voltage converter circuit 27 is configured to convert a drive current to be flowed toward the low potential power supply side by the current driver 19 into a voltage VI2, and to output the voltage VI2 to the comparator 28. The comparator 28 is configured to accept the voltage VI1 and the voltage VI2 respectively via its non-inverted input terminal and its inverted input terminal, and to output the output signal SQ representing a result of comparison. The current-voltage converter circuit 26 includes a current source transistor provided between an input node serving as a node for the non-inverted input terminal TP and a low potential power supply node, as well as includes a current-voltage conversion transistor and a variable resistance element transistor provided in series between a high potential power supply node and the input node. The current-voltage converter circuit 27 includes a current source transistor provided between an input node serving as a node for the inverted input terminal TN and the low potential power supply node, as well as includes a current-voltage conversion transistor and a variable resistance element transistor provided in series between the high potential power supply node and the input node. The current source transistor is an N-type transistor. The current-voltage conversion transistor is a diode-coupled, P-type transistor. The variable resistance element transistor is a P-type transistor having a gate configured to accept an output signal of an inverter configured to amplify a signal sent from the input node. JP-A-2005-236931 described above discloses the detailed configuration example of the reception circuit 20.

In FIG. 12, the variable resistance circuit 22 is provided between the non-inverted input terminal TP and the inverted input terminal TN of the reception circuit 20. The variable resistance circuit 22 includes the resistor R3 having a variable resistance value.

As illustrated in FIG. 12, the circuit device 10 is mounted on a flexible substrate 14 achieved by flexible printed circuit (FPC) tape, for example. The signals DP and DN enter from the controller 16, via signal lines formed on the flexible substrate 14, into the circuit device 10. To prevent a reflection and a loss in a waveform of a signal being transferred, it is desirable that impedance matching takes place to allow an output impedance Z1 on a side adjacent to the controller 16 and an input impedance Z2 of the circuit device 10 to match with each other. However, due to the flexible substrate 14 being used or the first variable capacitance circuit 30 to the fourth variable capacitance circuit 70 of the circuit device 10, the capacitances CP1 and CP2, and the parasitic resistances, for example, the output impedance Z1 and the input impedance Z2 might not match with each other, leading to such an event that impedance matching is unbalanced. For example, if the flexible substrate 14 achieved by FPC tape, for example, being used is bent, an impedance in a transfer route 15 in FIG. 12 might change. If the capacitances of the first variable capacitance circuit 30 to the fourth variable capacitance circuit 70 change, for example, the input impedance Z2 in the circuit device 10 might change.

In the exemplary embodiment, the variable resistance circuit 22 for impedance matching purpose is provided between the non-inverted input terminal TP and the inverted input terminal TN of the reception circuit 20. When the impedance in the transfer route 15 of the flexible substrate 14 changes or an impedance changes due to the capacitances of the first variable capacitance circuit 30 to the fourth variable capacitance circuit 70, for example, a resistance value of the variable resistance circuit 22 is changed to allow the output impedance and the input impedance to match with each other. For example, a control signal sent from the control circuit 90 in FIG. 11 is used to change a resistance value of the resistor R3 in the variable resistance circuit 22. For example, the control circuit 90 changes the resistance value of the variable resistance circuit 22 in accordance with at least one of the capacitances of the first variable capacitance circuit 30 to the fourth variable capacitance circuit 70. For example, the control circuit 90 changes the resistance value of the variable resistance circuit 22 in accordance with the capacitances of the first variable capacitance circuit 30 and the second variable capacitance circuit 40. Otherwise, the control circuit 90 changes the resistance value of the variable resistance circuit 22 in accordance with the capacitances of the first variable capacitance circuit 30, the second variable capacitance circuit 40, the third variable capacitance circuit 60, and the fourth variable capacitance circuit 70. As described above, impedance matching for allowing the output impedance and the input impedance to match with each other can be achieved, preventing a reflection and a loss in a waveform of a signal being transferred. Therefore, such an event that amplitude of a waveform of an input signal of the reception circuit 20 is unbalanced can be prevented, achieving optimum amplitude. To obtain an optimum waveform of an input signal of the reception circuit 20, it is desirable that the output impedance and the input impedance match with each other at each of nodes of the non-inverted input terminal TP and the inverted input terminal TN of the reception circuit 20.

Figure 13:
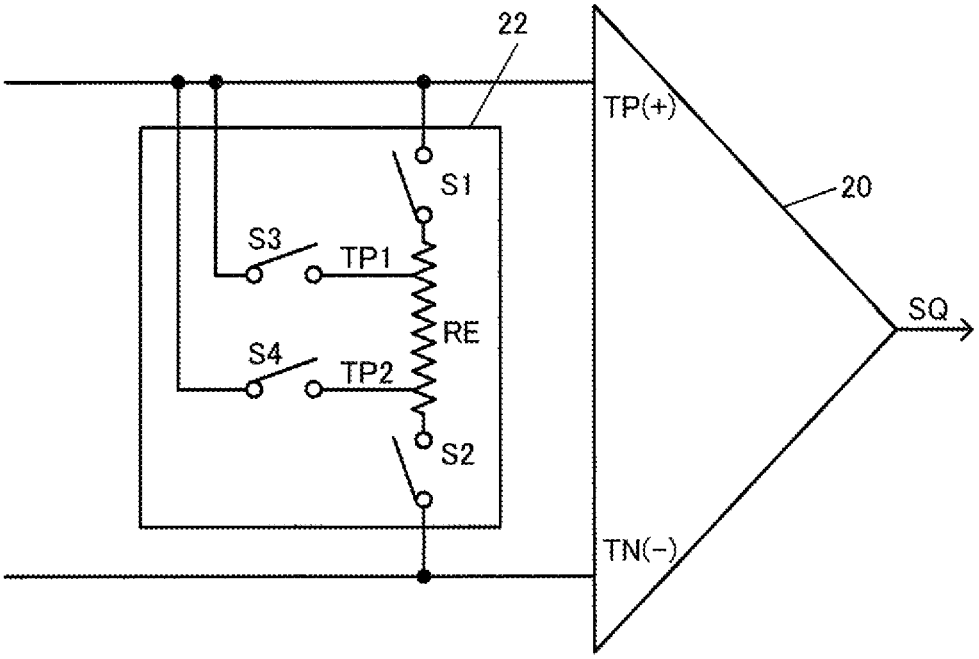
FIG. 13 is a diagram illustrating a configuration example of a variable resistance circuit.
Figure 14:
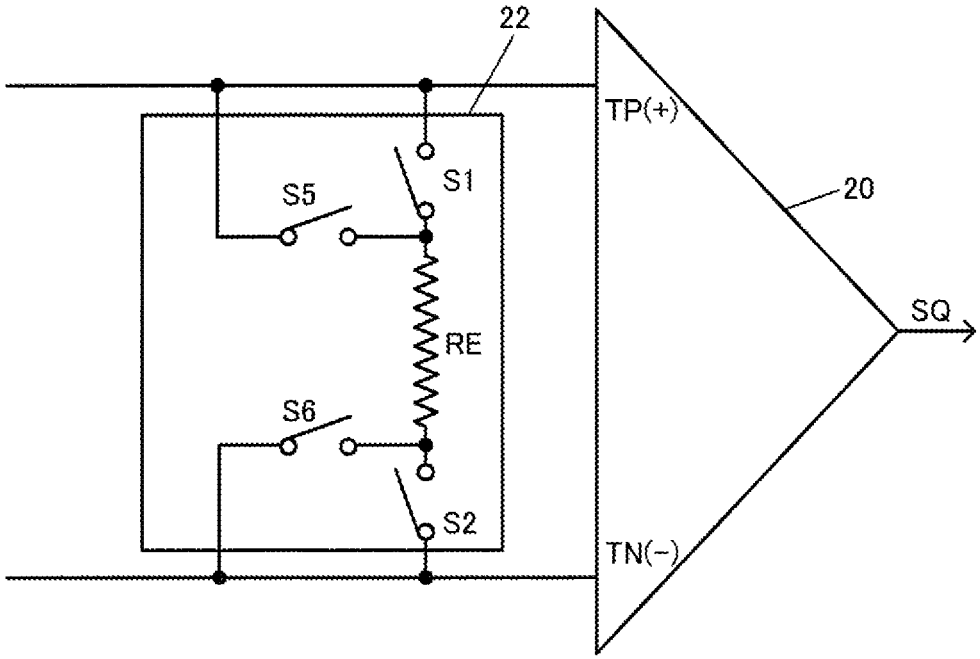
FIG. 14 is a diagram illustrating a configuration example of a variable resistance circuit.

FIGS. 13 and 14 illustrate configuration examples of the variable resistance circuit 22. The variable resistance circuit 22 in FIG. 13 includes a resistor RE and switches S1, S2, S3, and S4. The resistor RE corresponds to the resistor R3 in FIG. 12. The switch S1, the resistor RE, and the switch S2 are provided in series between the non-inverted input terminal TP and the inverted input terminal TN of the reception circuit 20. The switches S3 and S4 are respectively provided between the non-inverted input terminal TP and taps TP1 and TP2 of the resistor RE. Specifically, the switch S1 has an end coupled to the non-inverted input terminal TP and another end coupled to an end of the resistor RE. The switch S2 has an end coupled to the inverted input terminal TN and another end coupled to another end of the resistor RE. The switch S3 has an end coupled to the non-inverted input terminal TP and another end coupled to the tap TP1 of the resistor RE. The switch S4 has an end coupled to the non-inverted input terminal TP and another end coupled to the tap TP2 of the resistor RE.

With the configuration in FIG. 13, by turning off the switches S1, S2, S3, and S4, the resistor RE can be disconnected from the non-inverted input terminal TP and the inverted input terminal TN. By turning on the switches S1 and S2 and turning off the switches S3 and S4, the resistance value of the variable resistance circuit 22 can be set to a first resistance value. On the other hand, by turning off the switch S1 and turning on the switches S3 and S2 or by turning off the switch S1 and turning on the switches S4 and S2, the resistance value of the variable resistance circuit 22 can be set to a second resistance value smaller than the first resistance value. That is, the resistance value of the variable resistance circuit 22 can be variably set.

The variable resistance circuit 22 in FIG. 14 includes the resistor RE and the switches S1 and S2 and switches S5 and S6. The switch S1, the resistor RE, and the switch S2 are provided in series between the non-inverted input terminal TP and the inverted input terminal TN. The switch S5 is provided between the non-inverted input terminal TP and the end of the resistor RE. The switch S6 is provided between the inverted input terminal TN and the other end of the resistor RE. An on-resistance of the switch S5 is smaller than an on-resistance of the switch S1. An on-resistance of the switch S6 is smaller than an on-resistance of the switch S2.

With the configuration in FIG. 14, by turning off the switches S1, S2, S5, and S6, the resistor RE can be disconnected from the non-inverted input terminal TP and the inverted input terminal TN. By turning on the switches S1 and S2 having the greater on-resistances and turning off the switches S5 and S6, the resistance value of the variable resistance circuit 22 can be set to a third resistance value. On the other hand, by turning off the switches S1 and S2 and turning on the switches S5 and S6 having the smaller on-resistances, the resistance value of the variable resistance circuit 22 can be set to a fourth resistance value smaller than the third resistance value. That is, the resistance value of the variable resistance circuit 22 can be variably set.

Figure 15:
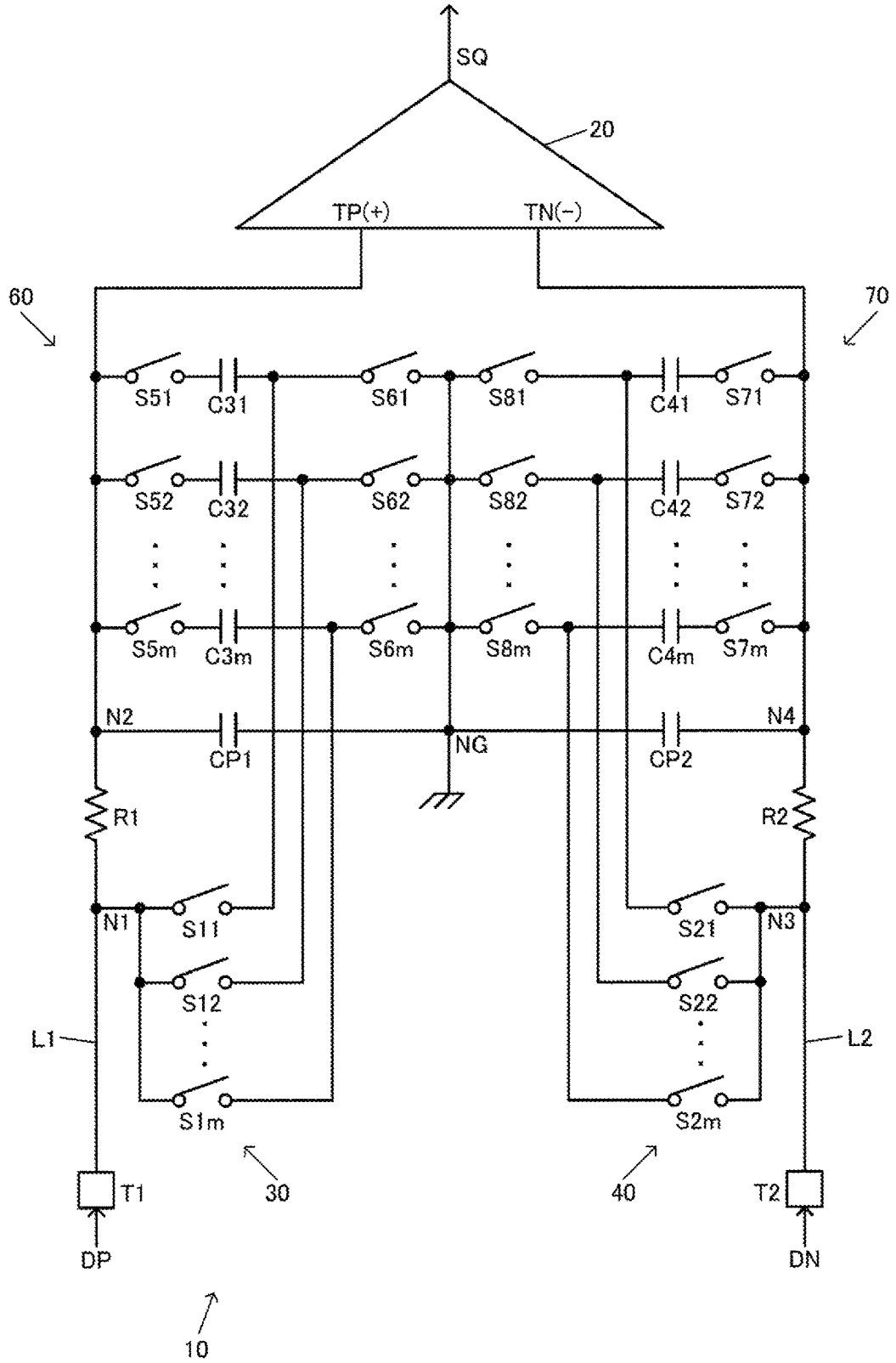
FIG. 15 is a diagram illustrating a modification example of the circuit device according to the exemplary embodiment.

FIG. 15 illustrates a modification example of the exemplary embodiment. In the modification example in FIG. 15, the first variable capacitance circuit 30 and the third variable capacitance circuit 60 share switches and capacitors. The second variable capacitance circuit 40 and the fourth variable capacitance circuit 70 share switches and capacitors.

Specifically, in FIG. 15, coupling nodes between capacitors C31 to C3*m* and switches S61 to S6*m* of the third variable capacitance circuit 60 are coupled to the end of the switches S11 to S1*m* of the first variable capacitance circuit 30. The other end of the switches S11 to S1*m* is coupled to the coupling node N1. Coupling nodes between capacitors C41 to C4*m* and switches S81 to S8*m* of the fourth variable capacitance circuit 70 are coupled to the end of the switches S21 to S2*m* of the second variable capacitance circuit 40. The other end of the switches S21 to S2*m* is coupled to the coupling node N3.

When phase correction for shaping a signal waveform into a signal waveform illustrated as A1 in FIG. 4 takes place to reduce a signal delay, the switches S61 to 6*m* and S81 to S8*m* are turned off. By using the switches S11 to S1*m*, the capacitors C31 to C3*m*, and switches S51 to S5*m*, the capacitance of the first variable capacitance circuit 30 is set. That is, by setting the switches S11 to S1*m* and the switches S51 to S5*m* to on or off, the capacitance of the first variable capacitance circuit 30 is set. By using the switches S21 to S2*m*, the capacitors C41 to C4*m*, and switches S71 to S7*m*, the capacitance of the second variable capacitance circuit 40 is set. That is, by setting the switches S21 to S2*m* and the switches S71 to S7*m* to on or off, the capacitance of the second variable capacitance circuit 40 is set.

On the other hand, when measuring the capacitances CP1 and CP2 described with reference to FIGS. 7 to 10, the switches S11 to S1*m* and the switches S21 to S2*m* are turned off. By using the switches S51 to 51*m*, the capacitors C31 to C3*m*, and the switches S61 to S6*m*, the capacitance of the third variable capacitance circuit 60 is set to measure the capacitance CP1. By using the switches S71 to 71*m*, the capacitors C41 to C4*m*, and the switches S81 to S8*m*, the capacitance of the fourth variable capacitance circuit 70 is set to measure the capacitance CP2. As described above, compared with the configuration in FIG. 8, for example, switches and capacitors can be reduced in number, reducing the circuit device 10 in size.

4. Electro-Optical Device

Next, a configuration example of the electro-optical device 250 using the circuit device 10 according to the exemplary embodiment will be described herein. The electro-optical device 250 in FIG. 16 includes the circuit device 10 including a display driver circuit 110, and an electro-optical panel 200. The display driver circuit 110 is configured to accept an output signal of the reception circuit 20 as a data signal to drive the electro-optical panel 200.

Figure 16:
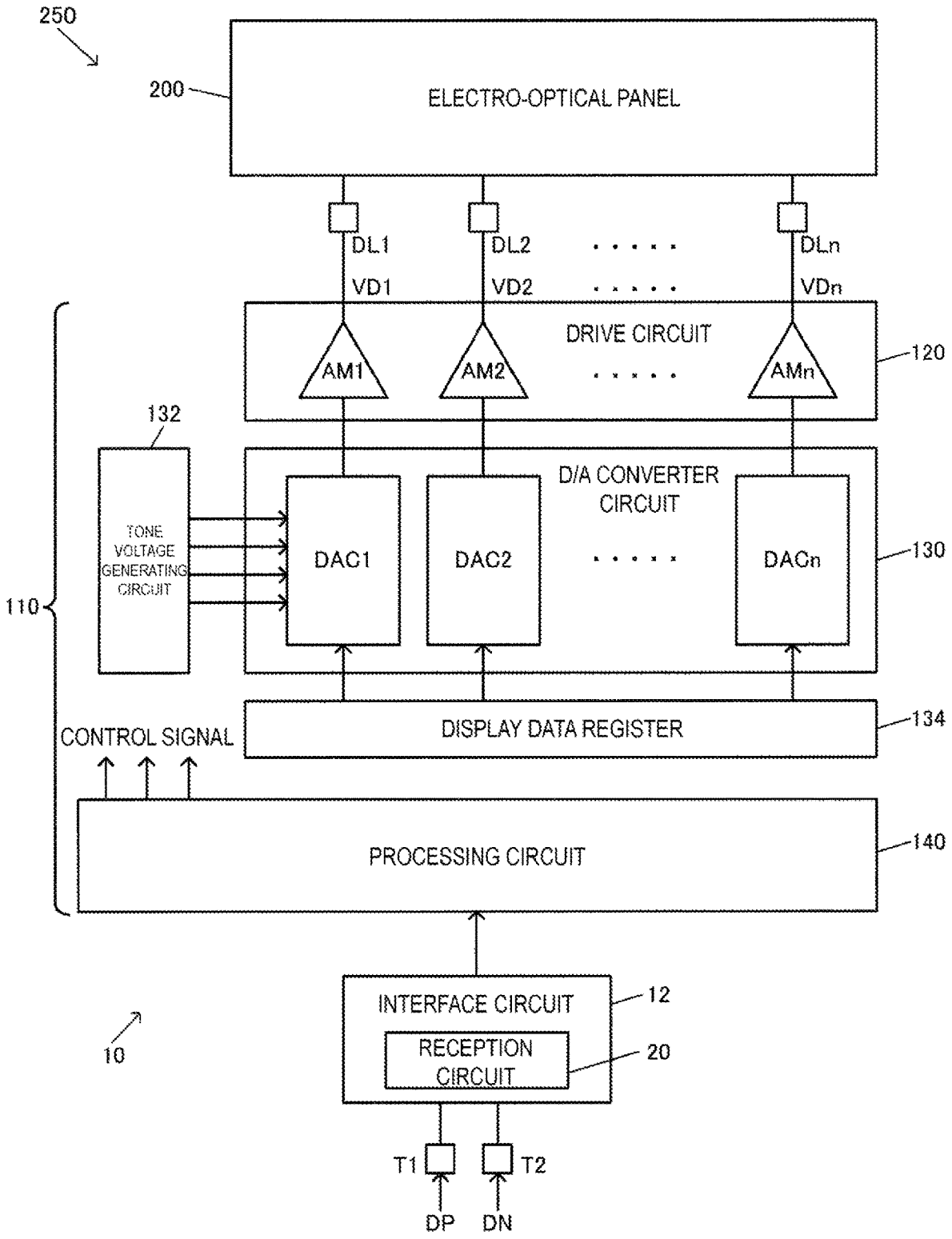
FIG. 16 is a diagram illustrating a configuration example of an electro-optical device according to the exemplary embodiment.

Specifically, in FIG. 16, the circuit device 10 serving as a display driver includes an interface circuit 12 and the display driver circuit 110. The interface circuit 12 includes the reception circuit 20, and is configured to accept the signals DP and DN sent from the external circuit device via the input terminals T1 and T2. The interface circuit 12 includes various circuits, such as the first variable capacitance circuit 30, the second variable capacitance circuit 40, the third variable capacitance circuit 60, and the fourth variable capacitance circuit 70 described with reference to FIGS. 1 to 13. The display driver circuit 110 is configured to accept the output signal of the reception circuit 20 of the interface circuit 12 as the data signal to drive the electro-optical panel 200 via the drive circuit 120.

The electro-optical panel 200 is a panel for displaying images, and can be implemented by a liquid crystal panel or an organic electro-luminescence (EL) panel, for example. An active-matrix panel using switching elements such as thin film transistors (TFTs) can be employed as the liquid crystal panel. Specifically, the electro-optical panel 200 serves as a display panel including a plurality of pixels. The plurality of pixels are disposed in a matrix, for example. The electro-optical panel 200 also includes a plurality of data lines and a plurality of scan lines laid in a direction intersecting with the plurality of data lines. Each pixel among the plurality of pixels is disposed at a region where each data line and each scan line intersect. In an active-matrix panel, a switching element such as a thin film transistor is disposed at each pixel region. The electro-optical panel 200 realizes display operations by causing the optical properties of electro-optical elements at the pixel regions to change. An electro-optical element is a liquid crystal element or an EL element, for example. Note that in an organic EL panel, pixel circuits for driving the EL elements with current are disposed at each pixel region.

The display driver circuit 110 includes a drive circuit 120, a digital/analog (D/A) converter circuit 130, a tone voltage generating circuit 132, a display data register 134, and a processing circuit 140. Note that the configuration of the display driver circuit 110 is not limited to the configuration in FIG. 16, and various modifications can be achieved by omitting a part of the components or adding another component, for example.

The drive circuit 120 is configured to output data voltages VD1 to VDn (n is an integer of 2 or greater) corresponding to display data to data lines DL1 to DLn to drive the electro-optical panel 200. The drive circuit 120 includes a plurality of amplifier circuits AM1 to AMn. The amplifier circuits AM1 to AMn output the data voltages VD1 to VDn to the data lines DL1 to DLn. The electro-optical panel 200 may be provided with a switching element for demultiplex purpose. The amplifier circuits AM1 to AMn may respectively output, in a time division manner, data voltages corresponding to a plurality of source lines of the electro-optical panel 200.

The processing circuit 140 is configured to perform various control processes, such as a display control for the electro-optical panel 200, controls of circuits in the circuit device 10, and an interface process with an external circuit device. The processing circuit 140 can be achieved with automatic arrangement wiring, such as a gate array. The processing circuit 140 outputs a plurality of control signals to execute the control processes. The processing circuit 140 accepts as data signals output signals of the reception circuit 20 of the interface circuit 12.

The display data register 134 is configured to latch the display data sent from the processing circuit 140. The display data denotes data based on a data signal representing an output signal of the reception circuit 20. The tone voltage generating circuit 132 is a gamma voltage circuit, and is configured to generate a plurality of tone voltages and to supply the plurality of tone voltages to the D/A converter circuit 130. The D/A converter circuit 130 includes a plurality of D/A converters DAC1 to DACn. The D/A converter circuit 130 is configured to select, from among the plurality of tone voltages sent from the tone voltage generating circuit 132, a tone voltage corresponding to the display data sent from the display data register 134, and to output the tone voltage being selected to the drive circuit 120. The drive circuit 120 is configured to output the tone voltage being selected to each of the data lines as a data voltage.

5. Electronic Apparatus, Projector

Figure 17:
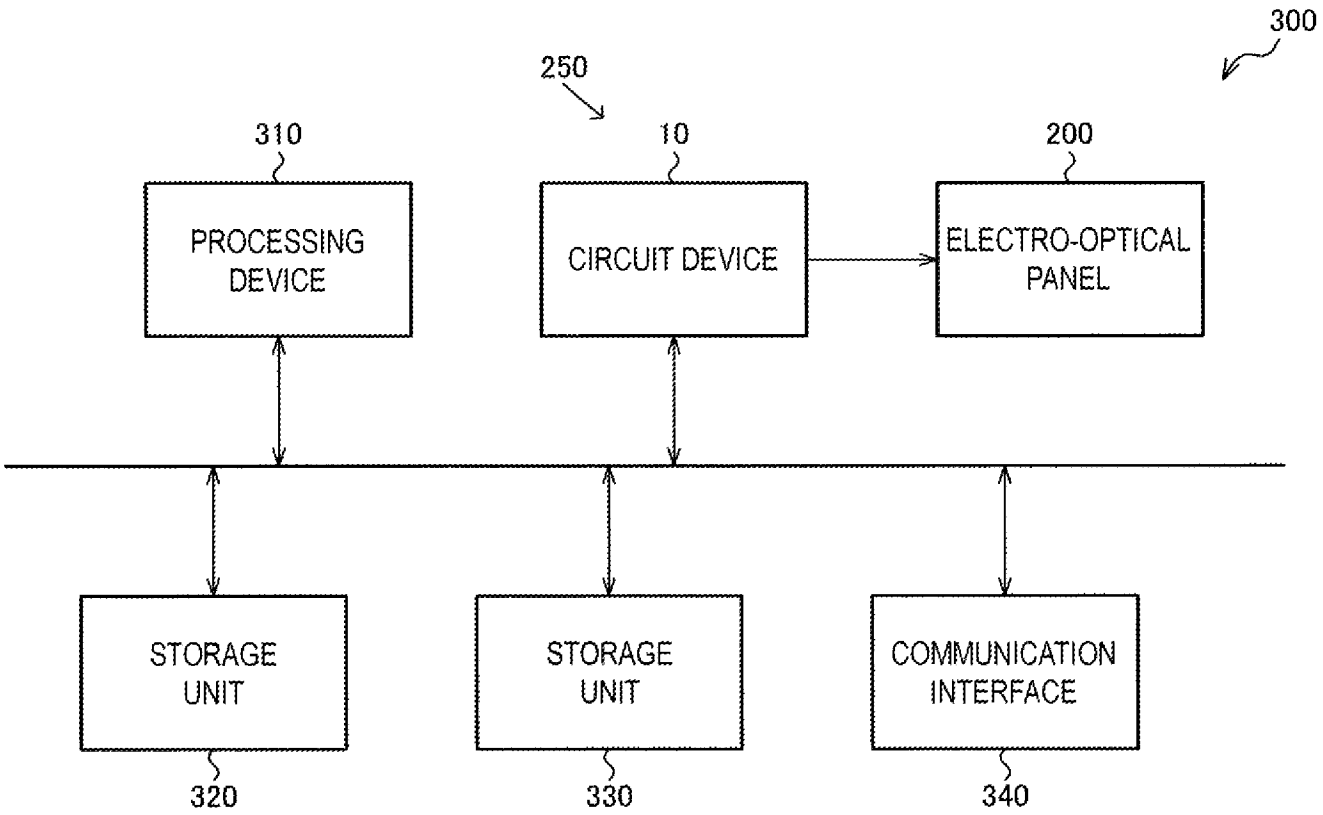
FIG. 17 is a diagram illustrating a configuration example of an electronic apparatus according to the exemplary embodiment.

FIG. 17 illustrates a configuration example of the electronic apparatus 300 including the circuit device 10 according to the exemplary embodiment. The electronic apparatus 300 includes the circuit device 10 according to the exemplary embodiment, the electro-optical panel 200, a processing device 310, a storage unit 320, an operation interface 330, a communication interface 340. The circuit device 10 serving as the display driver and the electro-optical panel 200 constitute the electro-optical device 250. Specific examples of the electronic apparatus 300 include various electronic devices, such as projectors, head-mounted displays, mobile information terminals, vehicle-mounted devices including meter panels and car navigation systems, mobile game consoles, robots, and information processing devices.

The processing device 310 carries out control processing for the electronic device 300, various types of signal processing, and the like. The processing device 310 can be realized by, for example, a processor such as a CPU or an MPU, an ASIC, or the like. The storage unit 320 stores data sent from the operation interface 330 and the communication interface 340, for example, or functions as a work memory for the processing device 310, for example. The storage unit 320 can be realized by, for example, a semiconductor memory such as a random access memory (RAM) or a read-only memory (ROM), a magnetic storage device such as a hard-disc drive (HDD), an optical storage device such as a compact disc (CD) drive or a digital versatile disc (DVD) drive, or the like. The operation interface 330 is a user interface for receiving various operations from a user. For example, the operation interface 330 can be realized by buttons, a mouse, a keyboard, a touch panel installed in the electro-optical panel 200, or the like. The communication interface 340 is an interface for use in communications of image data and control data. Communication processing carried out by the communication interface 340 may be wired communication processing or wireless communication processing.

When the electronic apparatus 300 is a projector, a projection unit including a light source and an optical system is further provided. The light source is realized by a lamp unit including a white light source such as a halogen lamp, for example. The optical system is realized by lenses, prisms, mirrors, or the like. In a case where the electro-optical panel 200 is a transmissive type, light from the light source is incident on the electro-optical panel 200 via the optical system and the like, and the light transmitted by the electro-optical panel 200 is projected onto a screen. In a case where the electro-optical panel 200 is a reflective type, light from the light source is incident on the electro-optical panel 200 via the optical system and the like, and the light reflected by the electro-optical panel 200 is projected onto a screen.

Although some exemplary embodiments have been described in detail above, those skilled in the art will understand that many modified examples can be made without substantially departing from the novel matter and effects of the disclosure. All such modified examples are thus included in the scope of the disclosure. For example, terms in the descriptions or drawings given even once along with different terms having identical or broader meanings can be replaced with those different terms in all parts of the descriptions or drawings. All combinations of the exemplary embodiments and modified examples are also included within the scope of the disclosure. The configurations, the operations, and the like of the circuit device, the electro-optical device, the electro-optical panel, the electronic apparatus, and the like are not limited to those described in the exemplary embodiments, and various modifications can be achieved.

The entire disclosure of Japanese Patent Application No. 2018-032855, filed Feb. 27, 2018 is expressly incorporated by reference herein.

What is claimed is:

1. A circuit device comprising:

a first input terminal;

a second input terminal;

a reception circuit including a non-inverted input terminal and an inverted input terminal;

a first signal line electrically coupling the non-inverted input terminal of the reception circuit and the first input terminal and having a first coupling node on a side adjacent to the first input terminal and a second coupling node on a side adjacent to the non-inverted input terminal;

a first fixed resistance provided on the first signal line between the first coupling node and the second coupling node;

a second signal line electrically coupling the inverted input terminal of the reception circuit and the second input terminal and having a third coupling node on a side adjacent to the second input terminal and fourth coupling node on a side adjacent to the inverted input terminal;

a second fixed resistance provided on the second signal line between the third coupling node and the fourth coupling node;

a first variable capacitance circuit having an end coupled to the first coupling node of the first signal line and another end coupled to the second coupling node of the first signal line;

a second variable capacitance circuit having an end coupled to the third coupling node of the second signal line, and another end coupled to the fourth coupling node of the second signal line;

a third variable capacitance circuit having an end coupled to the second coupling node and another end coupled to a ground node;

a fourth variable capacitance circuit having an end coupled to the fourth coupling node and another end coupled to the ground node;

a monitoring circuit configured to:

accept an output signal of the reception circuit;

monitor a signal delay in the output signal when the capacitances of the third variable capacitance circuit and the fourth variable capacitance circuit are changed; and output a result of monitoring; and an operational circuit configured to:

set a capacitance of the first variable capacitance circuit to equal a total capacitance between the first signal line and the ground node, based on the signal delay and the change of the capacitances of the third and fourth variable capacitance circuits, the total capacitance between the first signal line and the ground node including a wire capacitance of the first signal line, a gate capacitance of a transistor in the reception circuit, and a drain capacitance of a transistor in the first variable capacitance circuit; and set a capacitance of the second variable capacitance circuit to equal a total capacitance between the second signal line and the ground node, based on the signal delay and the change of the capacitances of the third and fourth variable capacitance circuits, the total capacitance between the second signal line and the ground node including a wire capacitance of the second signal line, a gate capacitance of a transistor in the reception circuit, and a drain capacitance of a transistor in the second variable capacitance circuit.

2. The circuit device according to claim 1, wherein the first variable capacitance circuit includes:

a first switch group having an end coupled to the first coupling node;

a second switch group having an end coupled to the second coupling node; and a first capacitor group provided between another end of the first switch group and another end of the second switch group, and the second variable capacitance circuit includes:

a third switch group having an end coupled to the third coupling node;

a fourth switch group having an end coupled to the fourth coupling node; and a second capacitor group provided between another end of the third switch group and another end of the fourth switch group.

3. The circuit device according to claim 1, further comprising:

a capacitance setting circuit configured to set capacitances of the first variable capacitance circuit and the second variable capacitance circuit.

4. The circuit device according to claim 3, further comprising:

a register configured to store setting information about the capacitances of the first variable capacitance circuit and the second variable capacitance circuit.

5. The circuit device according to claim 1, further comprising:

a first terminal;

a second terminal; and a retaining circuit of the monitoring circuit, the retaining circuit being configured to:

sample the output signal of the reception circuit based on a clock signal to be input from the first terminal;

retain a result of sampling; and output a signal about the result of sampling being retained to the second terminal.

6. The circuit device according to claim 1, wherein the third variable capacitance circuit includes:

a fifth switch group having an end coupled to the second coupling node;

a sixth switch group having an end coupled to the ground node; and a third capacitor group provided between another end of the fifth switch group and another end of the sixth switch group, and the fourth variable capacitance circuit includes:

a seventh switch group having an end coupled to the fourth coupling node;

an eighth switch group having an end coupled to the ground node; and a fourth capacitor group provided between another end of the seventh switch group and another end of the eighth switch group.

7. The circuit device according to claim 1, further comprising:

a variable resistance circuit provided between the non-inverted input terminal and the inverted input terminal, the variable resistance circuit having a variable resistance value.

8. An electro-optical device comprising:

the circuit device according to claim 1, the circuit device including a display driver circuit configured to accept an output signal of the reception circuit as a data signal to drive an electro-optical panel; and the electro-optical panel.

9. An electronic apparatus comprising the circuit device according to claim 1.

10. The circuit device according to claim 1, wherein the capacitance of the first variable capacitance circuit and the capacitance of the second variable capacitance circuit are set based on the signal delay and the change of the capacitances of the third and fourth variable capacitance circuits according to the following equations:

$$Y1=\alpha(CP+C1), \text{ and} \quad (1)$$

$$Y2=\alpha(CP+C2) \quad (2)$$

where Y1 and Y2 are values of the signal delay, C1 and C2 are values of the changed capacitances of the third and fourth variable capacitance circuits, CP is one of the capacitance of the first variable capacitance circuit and the capacitance of the second variable capacitance circuit that is being set, and $\alpha$ is an inclination of a line representing a relationship between the signal delay and the changed capacitances of the third and fourth variable capacitance circuits.

* * * * *